US012520951B2

(12) United States Patent
Karschnik et al.

(10) Patent No.: US 12,520,951 B2
(45) Date of Patent: Jan. 13, 2026

(54) BED CONNECTION INTERFACE

(71) Applicant: Sleep Number Corporation, Minneapolis, MN (US)

(72) Inventors: Kody Lee Karschnik, Plymouth, MN (US); Matthew Griffith, Buffalo, MN (US)

(73) Assignee: Sleep Number Corporation, Minneapolis, MN (US)

( * ) Notice: Subject to any disclaimer, the term of this patent is extended or adjusted under 35 U.S.C. 154(b) by 629 days.

(21) Appl. No.: 17/890,677

(22) Filed: Aug. 18, 2022

(65) Prior Publication Data

US 2023/0066140 A1 Mar. 2, 2023

Related U.S. Application Data

(60) Provisional application No. 63/236,939, filed on Aug. 25, 2021.

(51) Int. Cl.
*A47C 21/04* (2006.01)
*F24F 13/02* (2006.01)

(52) U.S. Cl.
CPC ..... *A47C 21/044* (2013.01); *F24F 13/0209* (2013.01)

(58) Field of Classification Search
CPC ..... A47C 21/042–048; A61G 7/05784; F24F 13/0209; F24F 13/0254
See application file for complete search history.

(56) References Cited

U.S. PATENT DOCUMENTS 4,765,375 A * 8/1988 Nakajima ..... F16B 2/22 138/155
5,730,120 A * 3/1998 Yonkers, Jr. ..... A47C 21/044 128/202.13
7,877,827 B2 2/2011 Comiskey et al.
7,996,936 B2 8/2011 Comiskey et al.
8,065,763 B2 11/2011 Brykalski et al.
8,091,926 B2 * 1/2012 Hofmann ..... F24F 13/0209 454/71
8,181,290 B2 5/2012 Brykalski et al.
(Continued)

OTHER PUBLICATIONS

U.S. Appl. No. 15/685,912, filed Aug. 24, 2017, Petrovski et al.
(Continued)

*Primary Examiner* — Eric J Kurilla
(74) *Attorney, Agent, or Firm* — Fish & Richardson P.C.

(57) ABSTRACT

Disclosed herein is an air duct system that can be easily, quickly, and securely installed and removed from modular air controllers at bed systems. The bed can include a mattress, foundation, air duct hose, hose retainer, and attachment plate. The foundation can support the mattress on a first foundation side and can define a foundation aperture extending between the first foundation side and a second foundation side. The air duct hose can at least partially extend through the mattress and have a first end exposed outside the mattress. The hose retainer can attach to the first end of the air duct hose. The attachment plate can mount at the first foundation side of the foundation and define a plate opening aligned with the foundation aperture. The hose retainer at the first end of the air duct hose can be removably coupled to the attachment plate at the first foundation side.

20 Claims, 23 Drawing Sheets

(56) References Cited

U.S. PATENT DOCUMENTS

| | | | | |
|---|---|---|---|---|
| 8,191,187 | B2 | 6/2012 | Brykalski et al. | |
| 8,332,975 | B2 | 12/2012 | Brykalski et al. | |
| 8,402,579 | B2 | 3/2013 | Comiskey et al. | |
| 8,418,286 | B2 | 4/2013 | Brykalski et al. | |
| 8,621,687 | B2 | 1/2014 | Brykalski et al. | |
| 8,732,874 | B2 | 5/2014 | Brykalski et al. | |
| 8,782,830 | B2 | 7/2014 | Brykalski et al. | |
| 8,893,329 | B2 | 11/2014 | Petrovski et al. | |
| 9,125,497 | B2 | 9/2015 | Brykalski et al. | |
| 9,131,781 | B2 | 9/2015 | Zaiss et al. | |
| 9,603,459 | B2 | 3/2017 | Brykalski et al. | |
| 9,622,588 | B2 | 4/2017 | Brykalski et al. | |
| 9,814,641 | B2 | 11/2017 | Brykalski et al. | |
| 9,974,394 | B2 | 5/2018 | Brykalski et al. | |
| 10,194,752 | B2 | 2/2019 | Zaiss et al. | |
| 10,226,134 | B2 | 3/2019 | Brykalski et al. | |
| 10,405,667 | B2 | 9/2019 | Comiskey et al. | |
| 10,675,198 | B2 | 6/2020 | Brykalski et al. | |
| 10,772,438 | B2 | 9/2020 | Griffith et al. | |
| 11,020,298 | B2 | 6/2021 | Brykalski et al. | |
| 11,045,371 | B2 | 6/2021 | Brykalski et al. | |
| 11,083,308 | B2 | 8/2021 | Zaiss et al. | |
| 11,297,953 | B2 | 4/2022 | Brykalski et al. | |
| 12,053,096 | B2 * | 8/2024 | Palashewski | A47C 17/86 |
| 2003/0160452 | A1 * | 8/2003 | Mattsson | F24F 13/0209 285/424 |
| 2008/0007055 | A1 * | 1/2008 | Nohara | F24F 13/0209 285/317 |
| 2008/0148481 | A1 * | 6/2008 | Brykalski | A47C 21/048 5/423 |
| 2010/0011502 | A1 * | 1/2010 | Brykalski | A47C 21/04 5/423 |
| 2010/0047013 | A1 * | 2/2010 | Hofmann | F16L 37/098 403/336 |
| 2012/0146329 | A1 * | 6/2012 | McAven | F16L 21/08 285/374 |
| 2014/0026320 | A1 | 1/2014 | Comiskey et al. | |
| 2015/0238020 | A1 | 8/2015 | Petrovski et al. | |
| 2016/0066701 | A1 | 3/2016 | Diller et al. | |
| 2017/0071359 | A1 | 3/2017 | Steele et al. | |
| 2017/0191684 | A1 * | 7/2017 | Tompkins | F24F 7/065 |
| 2017/0273470 | A1 | 9/2017 | Brykalski et al. | |
| 2017/0280883 | A1 | 10/2017 | Diller | |
| 2018/0027981 | A1 * | 2/2018 | Sherman | A47C 21/044 |
| 2019/0059603 | A1 * | 2/2019 | Griffith | A47C 20/04 |
| 2019/0320808 | A1 * | 10/2019 | Chapin | A47C 21/044 |
| 2020/0000242 | A1 * | 1/2020 | Ermalovich | F04D 29/601 |
| 2020/0326094 | A1 * | 10/2020 | Lanciaux | F16L 9/04 |
| 2020/0337470 | A1 | 10/2020 | Sayadi et al. | |
| 2021/0037987 | A1 | 2/2021 | Griffith et al. | |
| 2021/0038453 | A1 | 2/2021 | Brykalski et al. | |
| 2021/0204706 | A1 | 7/2021 | Karschnik et al. | |
| 2021/0204709 | A1 | 7/2021 | Grabinger et al. | |
| 2021/0204710 | A1 | 7/2021 | Grabinger et al. | |
| 2021/0204711 | A1 | 7/2021 | Karschnik et al. | |
| 2021/0204712 | A1 | 7/2021 | Karschnik et al. | |
| 2021/0204713 | A1 | 7/2021 | Karschnik et al. | |
| 2021/0204714 | A1 | 7/2021 | Karschnik et al. | |
| 2021/0204715 | A1 | 7/2021 | Karschnik et al. | |
| 2021/0204716 | A1 | 7/2021 | Karschnik et al. | |
| 2021/0204719 | A1 | 7/2021 | Grabinger et al. | |
| 2021/0204720 | A1 * | 7/2021 | Karschnik | A47C 20/041 |
| 2021/0322237 | A1 | 10/2021 | Brykalski et al. | |
| 2021/0322238 | A1 | 10/2021 | Brykalski et al. | |
| 2021/0401185 | A1 | 12/2021 | Zaiss et al. | |
| 2022/0232990 | A1 | 7/2022 | Brykalski et al. | |
| 2022/0261020 | A1 | 8/2022 | Molina et al. | |
| 2022/0273115 | A1 | 9/2022 | Pedersen et al. | |
| 2022/0287473 | A1 * | 9/2022 | Karschnik | A47C 21/044 |
| 2023/0063576 | A1 * | 3/2023 | Grabinger | A47C 21/044 |

OTHER PUBLICATIONS

U.S. Appl. No. 15/973,279, filed May 7, 2018, Brykalski et al.
U.S. Appl. No. 17/890,677, filed Aug. 18, 2022, Karschnik et al.
U.S. Appl. No. 17/890,697, filed Aug. 18, 2022, Grabinger et al.
U.S. Appl. No. 17/964,150, filed Oct. 12, 2022, Grabinger et al.
U.S. Appl. No. 17/982,730, filed Nov. 8, 2022, Karschnik et al.
U.S. Appl. No. 18/091,765, filed Dec. 30, 2022, Brykalski et al.
U.S. Appl. No. 18/097,144, filed Jan. 13, 2023, Griffith et al.

* cited by examiner

BED CONNECTION INTERFACE

CROSS-REFERENCE TO RELATED APPLICATIONS

This application claims priority to U.S. Provisional Application Ser. No. 63/236,939, filed on Aug. 25, 2021, the disclosure of which is incorporated by reference in its entirety.

TECHNICAL FIELD

This document describes modular interfaces, devices and systems for connecting components of a bed, and methods for coupling components of a bed.

BACKGROUND

In general, a bed is a piece of furniture used as a location to sleep or relax. Many modern beds include a soft mattress on a foundation. The mattress may include springs, foam material, and/or an air chamber to support the weight of one or more occupants. Various features and systems have been used in conjunction with beds, including air control devices and systems for controlling a microclimate of a bed. For example, a heating and/or cooling system can be provided for heating and/or cooling air at or around a top of a mattress so as to provide a desired temperature to a user on the mattress. There is a need for a convenient and reliable mechanism for coupling different components of such a heating and/or cooling system in the bed.

SUMMARY

The document generally relates to an air duct system having a modular air controller configured to control a microclimate of a bed, and mechanisms that connect the air duct system to the bed in a convenient, reliable, and robust manner. The air controller, for example, can supply ambient or conditioned air towards a top of the bed, or draw air from the top of the bed, thereby controlling a temperature and/or humidity level at the top of the bed. More specifically, the air duct system can provide for airflow optimization. According to implementations of the present application, the air duct system includes one or more attachment mechanisms for easy, intuitive, and quick attachment and removal of the air duct system to the bed. In some implementations, the attachment mechanism can include snaps and locking tabs that provide for easy and controllable attachment of the air duct system to one or more components of the bed, such as the modular air controller (e.g., fan assembly, thermal engine). In some implementations, the attachment mechanism can include a slide in/slide out locking collar to configure an air duct hose to the modular air controller. Further, the attachment mechanisms described herein can provide a breakaway safety feature for easy breakaway of the air duct system from the modular air controller when unexpected force is applied to the bed. As a result, components of the bed may not be damaged by the unexpected force.

Particular embodiments described herein include a bed system having a mattress, a foundation having a first foundation side and a second foundation side, an air duct hose at least partially extending through the mattress and having a first end being exposed outside the mattress, a hose retainer attached to the first end of the air duct hose, and an attachment plate that can be mounted at the first foundation side of the foundation and can define a plate opening that is aligned with a foundation aperture. The foundation can support the mattress on the first foundation side and the foundation can define the foundation aperture extending between the first foundation side and the second foundation side. The hose retainer at the first end of the air duct hose can be removably coupled to the attachment plate at the first foundation side.

In some implementations, the system can optionally include one or more of the following features. For example, the bed system can also include an air distribution layer. A second end of the air duct hose can be fluidly connected to the distribution layer, the second end being opposite to the first end of the air duct hose. As another example, the bed system can also include an air controller that can cause air to flow through the air duct hose. The air controller can be positioned at the second foundation side of the foundation and can be attached to the attachment plate through the foundation aperture. As yet another example, the air controller can be in fluid communication with the air duct hose through the foundation aperture and the plate opening. In some implementations, the hose retainer at the first end of the air duct hose can be configured to be snap-fitted to the attachment plate at the first foundation side.

As another example, the hose retainer can include snaps, and the attachment plate can define engaging holes that can receive and engage the snaps of the hose retainer. In some implementations, the snaps of the hose retainer can be flexed as the snaps are pushed through the engaging holes of the attachment plate to engage the hose retainer to the attachment plate. In some implementations, each of the snaps of the hose retainer can include a locking tab and a hook extending from the locking tab, the locking tab being able to be flexed. Moreover, in some implementations, the locking tabs can be inserted into the engaging holes of the attachment plate in a first direction, the hooks can, based on the locking tabs being inserted into the engaging holes of the attachment plate, contact engaging portions of the attachment plate, the engaging portions of the attachment plate can restrict movement of the hose retainer in a second direction opposite to the first direction, and the engaging portions of the attachment plate can define the engaging holes of the attachment plate. In some implementations, the engaging portions of the attachment plate can be defined by a thickness of the attachment plate around the engaging holes of the attachment plate. In some implementations, the locking tabs can be flexed as the hooks contact inner peripheries the engaging holes of the attachment plate, and can be flexed back to their original shapes when the hooks pass the engaging holes of the attachment plate.

As another example, the hose retainer can releasably attach to the first end of the air duct hose. In some implementations, the air duct hose can automatically detach from the hose retainer when a threshold amount of force is applied to the bed system. In yet some implementations, the hose retainer can include a protruding feature, and the first end of the air duct hose can stretch over a protruding feature of the retainer. In some implementations, the hose retainer can include an engagement portion including an overhang edge, the overhand edge defining an opening that is in fluid communication with the first end of the air duct hose. In yet some implementations, the first end of the air duct hose can include a rib, the rib being inserted into a space defined by the engagement portion of the hose retainer, and the overhang edge of the hose retainer can maintain the rib of the air duct hose within the space. Moreover, the air duct hose can be made of a first material, and the hose retainer can be made of a second material being less flexible than the first material. In some implementations, the first material can be silicone and the second material can be plastic.

As yet another example, the air duct hose can include a center rib that can extend in a direction of airflow through the air duct hose. Moreover, the hose retainer can be a ring shape that corresponds to a shape of the bottom of the air duct hose. The hose retainer can also define an opening that can be a same size as at least one of an opening of the air duct hose and the plate opening of the attachment plate. As another example, the hose retainer can move laterally in a direction that is parallel with a top surface of the attachment plate, and can slide into a locked position on the attachment plate. In some implementations, the hose retainer can be held in place to the attachment plate by friction. In some implementations, the attachment plate can also include locking tabs positioned at corners of the attachment plate that can protrude from the attachment plate and retain the hose retainer to the attachment plate. Sometimes, the hose retainer can include a recessed edge along a bottom flange of the hose retainer and the locking tabs of the attachment plate can align with the recessed edge when the hose retainer is slid onto the attachment plate. In yet some implementations, the locking tabs of the attachment plate can press the recessed edge of the hose retainer against the top surface of the attachment plate so as to prevent the hose retainer from sliding off of the attachment plate.

One or more embodiments described herein can include a method for assembling a bed system, the method including mounting an attachment plate at an upper foundation side of a foundation, the attachment plate defining a plate opening that can be aligned with a foundation aperture extending between the upper foundation side and a bottom foundation side of the foundation, positioning a mattress on the upper foundation side of the foundation, the mattress including an air duct hose that can have a mattress end and a foundation end, the foundation end attaching a hose retainer, and coupling the hose retainer of the air duct hose to the attachment plate at the upper foundation side.

In some implementations, the method can optionally include one or more of the following features. For example, the method can also include coupling an air controller to the attachment plate at the lower foundation side. Coupling the hose retainer of the air duct hose to the attachment plate can include snap-fitting the hose retainer to the attachment plate. In some implementations, the hose retainer can include snaps, and the attachment plate can define engaging holes, and snap-fitting the hose retainer to the attachment plate can include pushing the snaps of the hose retainer into the engaging holes of the attachment plate, respectively. In some implementations, each of the snaps of the hose retainer can include a locking tab and a hook extending from the locking tab, and pushing the snaps of the hose retainer into the engaging holes of the attachment plate can include pushing the locking tabs of the hose retainer through the engaging holes of the attachment plate in a first direction until the hooks of the hose retainer pass the engaging holes of the attachment plate.

As another example, the method can also include disengaging the hose retainer of the air duct hose from the attachment plate at the upper foundation side. In some implementations, the method can include flexing the snaps of the hose retainer, and pulling the flexed snaps of the hose retainer away from the upper foundation side until the snaps of the hose retainer are removed from the attachment plate. In some implementations, the method can also include flexing the locking tabs of the hose retainer, and pulling the flexed locking tabs away from the upper foundation side until the hooks of the hose retainer are removed from the engaging holes of the attachment plate. In some implementations, the mattress can include a distribution layer and the mattress end of the air duct hose can be fluidly connected to the distribution layer. As another example, the hose retainer can include means for being received in openings of the attachment plate.

One or more embodiments described herein can also include a bed system having a mattress, a foundation, an attachment plate, and a plenum. The foundation can have a first foundation side and a second foundation side. The foundation can support the mattress on the first foundation side, the foundation defining a foundation aperture extending between the first foundation side and the second foundation side. The attachment plate that can be mounted at the first foundation side of the foundation can define a plate opening that can be aligned with the foundation aperture. The plenum can have a first plenum end and an opposite second plenum end. The first plenum end can removably couple to the attachment plate at the first foundation side, and the second plenum end can couple to an air duct hose that can be fluidly connected to the mattress.

In some implementations, the bed system can optionally include one or more of the following features. For example, the air duct hose can at least partially extend through the mattress and can have a first hose end being exposed outside the mattress and a second hose end opposite the first hose end. The second hose end of the air duct hose can fit over at least a portion of the plenum to retain the air duct hose to the plenum. In some implementations, the air duct hose can include a center rib positioned along an inside the air duct hose that can provide structural support to the air duct hose to maintain air flow through the air duct hose when pressure may be applied to one or more components of the bed system.

As another example, the air duct hose can include a key positioned inside the air duct hose and the plenum can include a slot that can receive the key to retain the air duct hose to the plenum. As yet another example, the plenum further can include a ridge extending around a perimeter of the plenum, and one or more ribs of the air duct hose can slide over the ridge such that the ridge retains the air duct hose to the plenum.

In some implementations, the bed system can also include an air controller that can attach to the attachment plate. The air controller can include a pivot bar, and the attachment plate can include a receiving cup at a first portion of the attachment plate that can receive the pivot bar of the air controller to thereby couple the air controller to the attachment plate. In some implementations, the attachment plate can include a first attachment plate and a second attachment plate, and the second attachment plate can include (i) the receiving cup at a first portion of the second attachment plate that can receive the pivot bar of the air controller and (ii) a locking tab at a bottom surface of the second attachment plate that can engage with an engagement portion of the air controller. In yet some implementations, the first attachment plate can include engagement connectors along a perimeter of a bottom surface of the first attachment plate that can snap fit into corresponding receivers along a perimeter of a top surface of the second attachment plate, thereby coupling the first attachment plate to the second attachment plate. Moreover, the first attachment plate can be placed at the first foundation side and the second attachment plate can be placed at the second foundation side.

In some implementations, the first attachment plate can include first and second apertures on opposing sides of a top surface of the first attachment plate that can receive first and second engagement tabs of the plenum. The plenum can couple to the first attachment plate with the one or more engagement tabs being snap-fitted to the one or more apertures. As another example, the plenum can include first and second engagement tabs, and the first and second engagement tabs can snap fit into first and second apertures on opposing sides of a top surface of the attachment plate. In some implementations, the first and second engagement tabs can include respective first and second flanges that can engage with respective portions of the attachment plate adjacent the first and second apertures when the first and second engagement tabs are inserted and snapped into the first and second apertures. As yet another example, the first and second engagement tabs can include U-shape portions that can be flexed in a direction towards the plenum such that the first and second flanges disengage from the respective portions of the attachment plate to detach the plenum from the attachment plate.

Moreover, in some implementations, the first and second engagement tabs can be configured to be flexed as the first and second engagement tabs are pushed through the first and second apertures on opposing sides of the top surface of the attachment plate to engage the plenum to the attachment plate. The air duct hose can be made of a first material, and the plenum can be made of a second material being less flexible than the first material. The first material can be silicone and the second material can be plastic. The plenum can define, in some implementations, an opening that can be a same size as at least one of an opening of the air duct hose and the plate opening of the attachment plate. The bed system can also include an air distribution layer, and an end of the air duct hose can be fluidly connected to the distribution layer. Sometimes, the air controller can also be in fluid communication with the air duct hose through the foundation aperture and the plate opening.

The devices, system, and techniques described herein may provide one or more of the following advantages. For example, the disclosed technology can include a safe breakaway function. The breakaway function can be advantageous to prevent damage to the bed system and/or components of the bed system. More specifically, the breakaway function can prevent damage to one or more components, including the air duct system, from over-stress. Examples of overstress can include a user attempting to remove the mattress without disconnecting a hose from the foundation or another component of the bed system. The breakaway feature therefore can prevent damage to components such as one or more layers of the mattress, thereby reducing or avoiding a possibility that the mattress may need to be replaced. The breakaway function can be achieved by a specially-designed hose fitting. In particular, a hose made of a first material (e.g., silicone) is fitted to a retainer made of a second material (e.g., plastic), and the retainer is configured to attach the hose to a component of the bed. The retainer is configured to allow the hose to slip out of the retainer with a certain amount of force pulling the hose away from the retainer. Such slip-out feature can be advantageous to improve performance and retention of the air duct system to one or more components, such as the thermal engine, without causing degradation to any of such components after a breakaway event may occur. Therefore, after the breakaway event, components such as the retainer (e.g., a hose retainer) or a foundation may not have to be replaced. Moreover, the hose fitting can be easier to dial in and control a breakaway force, since the material (e.g., silicone) of the hose can provide for more flexibility than the material of the retainer (e.g., a rigid plastic).

As another example, the air duct system can include a center rib down the hose, thereby avoiding collapse of walls of the duct when external pressures are applied to the bed system. The center rib is configured, arranged, and oriented, so as not to substantially impact airflow. For example, the center rib extends in the direction of airflow along and inside the hose to thereby reduce interference of airflow along the hose. In addition or alternatively, the center rib is designed to have a length, height, and width that can reduce interference with airflow along the hose. Airflow can therefore be optimized even when external pressures are applied to the bed. Moreover, the center rib can protect the hose from being damaged when such external pressures are applied to the bed. Without the center rib, the hose may collapse when other mattress components push up against the hose, thereby restricting or otherwise stopping air flow through the hose. The center rib can include two extended profiles that run down a center of the hose. Even if the two extended profiles meet in a middle shift or are offset so that they permit the hose to compress to some degree (e.g., up to 50% of the original shape), sufficient air flow can still be maintained.

As another example, the air duct system can be shaped and sized to optimize airflow. Moreover, the shape and size of the duct can be contoured for clearance of one or more components of the mattress and/or overall bed system. As a result, the air duct system can be installed or integrated into different bed system configurations.

The details of one or more implementations are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

This document generally relates to an air duct system that can be easily, quickly, and securely installed and removed from a modular air controller (e.g., thermal engine) at bed systems. The air duct system can have a breakaway feature to prevent damage to one or more components of the air duct system and the bed system when unexpected external pressure is applied to the bed system.

Figure 1:
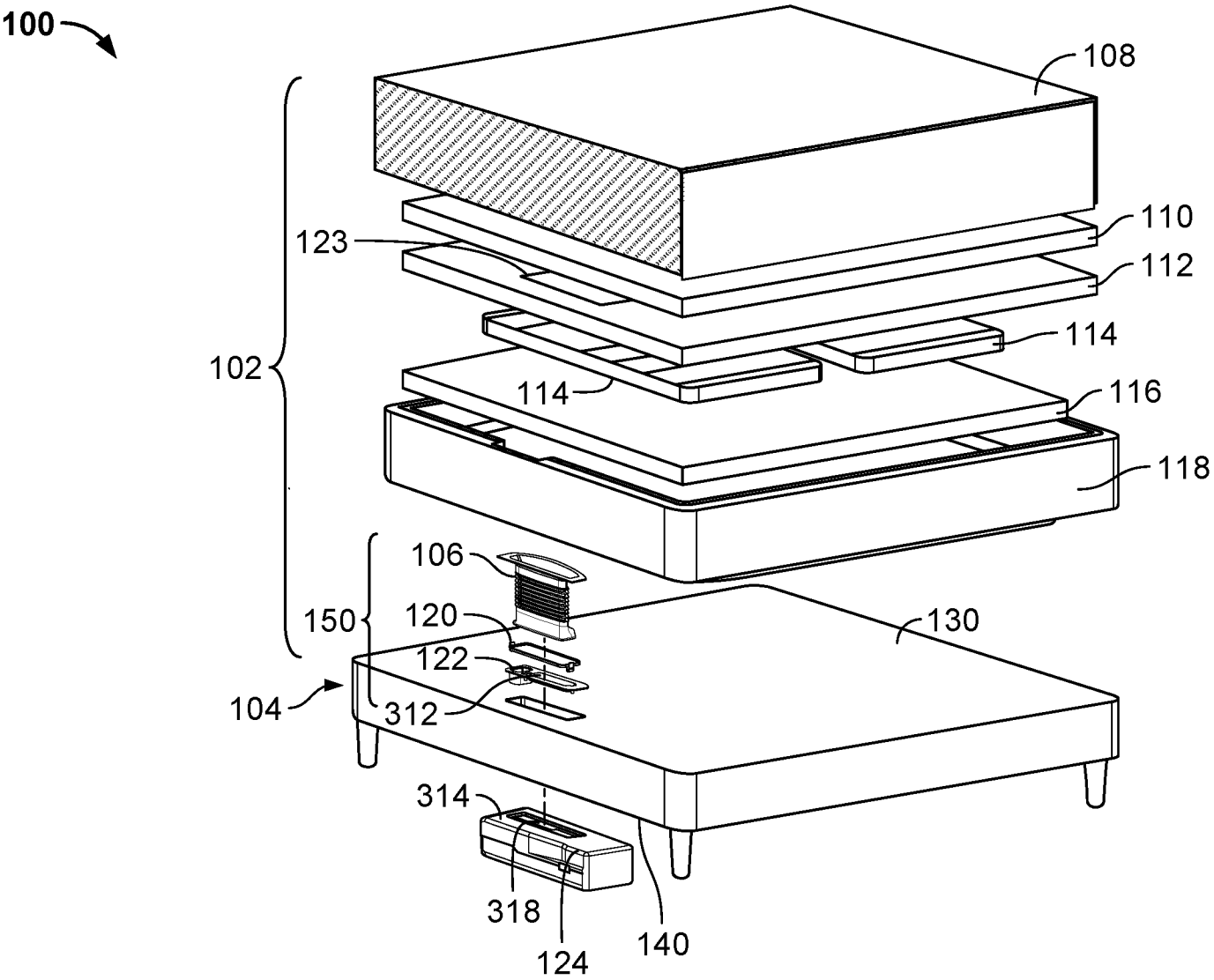
FIG. 1 is an example bed system with an air duct system as described herein.

Referring to the figures, FIG. 1 is an example bed system 100 with an air duct system 150 as described herein. In this example, the bed system 100 includes a mattress 102 and a foundation 104, which can be configured to be identical or similar to the mattresses and the foundations described herein. The foundation 104 can be a box type foundation with or without a hollow interior. Alternatively, the foundation 104 can also be of a plate type and provide a solid plate that supports the mattress 102 thereon. Other configurations of the foundation are also possible. The foundation 104 can provide a first foundation surface 130 and a second foundation surface 140 that is opposite to the first foundation surface 130. The first foundation surface 130 can be a top surface of the foundation 104 on which the mattress 102 is supported. The second foundation surface 140 can be a bottom surface of the foundation 104 that is reachable from under the foundation 104. As described herein, an air controller 124 (e.g., the thermal engine 124) can be attached to the second foundation surface 140 (e.g., the bottom surface of the foundation 104) so that the air controller 124 is placed and secured under the foundation 104.

In general, the mattress 102 can be configured as a climate-controlled mattress, and include a mattress core, an air distribution layer, an air hose (e.g., air duct hose), an air controller, and a mattress cover. Referring to FIG. 1, the mattress core can include an air chamber assembly 114. The air distribution layer can include an air distribution layer 123 (e.g., airflow inserts). The air hose can include an air duct hose 106. The mattress cover can include a mattress cover 108. The mattress core is configured to support a user resting on the mattress. The air distribution layer is configured to facilitate air flow for climate control of a top surface of the mattress. The air hose is configured to route ambient or conditioned air into and from the air distribution layer. The air controller (e.g., thermal module engine) is fluidly connected to the air distribution layer via the air hose, and operates to cause ambient or conditioned air to flow into or from the air distribution layer. The mattress cover is used to enclose the mattress core, the air distribution layer, and at least part of the air hose.

Still referring to FIG. 1, the mattress 102 can include a top layer 110, an intermediate layer 112, an air distribution layer 123 (e.g., airflow inserts, airflow insert pads), a rail structure 118, a bottom layer 116, and an air chamber assembly 114. Any one or more of the layers 110, 112, 114, 116, and/or 118 can be made of foam, fabric, or another compressible or non-compressible material. At least some of the layers 110, 112, 114, 116, and 118 can be made of a same material. Alternatively, at least some of the layers 110, 112, 114, 116, and 118 can be made of different materials with different properties. Further, the mattress 102 can include a mattress cover 108 having a top surface, a bottom surface, and side surfaces, which are configured to at least partially cover the top layer 110, the intermediate layer 112, the rail structure 118, the bottom layer 116, and the air chamber assembly 114.

The air distribution layer 123 can be included in the mattress 102 and configured to circulate ambient or conditioned air through the mattress 102 under the user at rest. The airflow distribution layer 123 can be positioned under the top layer 110. In some implementations, the intermediate layer 112 defines a cutout section or recess to receive the airflow distribution layer 123 therein. As illustrated, the mattress 102 includes the air duct hose 106 that can fluidly connect to the airflow distribution layer 123. Ambient or conditioned air can then flow from the air controller 124, through the air duct hose 106, and into the airflow distribution layer 123 such that the ambient or conditioned air can be circulated around layers of the mattress 102. The air controller 124 can also be configured to draw air from the airflow distribution layer 123 into the air controller 124.

The airflow distribution layer 123 can include a material having a higher air permeability than the top layer 110, the intermediate layer 112 and/or other adjacent layers, thereby promoting airflow through the airflow distribution layer 123 as opposed to its adjacent layer(s) such as the top layer 110 and the intermediate layer 112. A single airflow distribution layer 123, two, or more than two airflow distribution layers 123 can be included in implementations of the mattress 102. The airflow distribution layer 123 can be arranged at various locations in the mattress 102. For example, the airflow distribution layer 123 can be disposed between the head and foot of the mattress 102 (e.g., in the middle of the mattress). The layer 123 can also be disposed closer to the head of the mattress 102 or the foot of the mattress 102 to optimize positioning. In some implementations, the layer 123 can be laminated in place using adhesive. The layer 123 can also be held in place using one or more other attaching means, such as hook and loop fasteners and/or zippers. In other implementations, the airflow distribution layer 123 can be seated in, or fitted into, the cutout section or recess defined in the intermediate layer 112, with or without adhesive or other attaching means.

The air duct system 150 can include the air duct 106, the attachment plate 122, and a hose retainer 120. The hose retainer 120 can snap onto a bottom of the air duct hose 106, and configured to attach the air duct hose 106 to a component (e.g., the attachment plate 122) of the bed. In some implementations, the hose retainer is configured as a rim or ring having a shape that corresponds to and is fitted to the end of the air duct hose 106. For example, the hose retainer 120 can snap along a bottom rib of the air duct hose 106, thereby securing the hose retainer 120 to the air duct hose 106. As described throughout this disclosure, the snap attachment of the hose 106 to the hose retainer 120 can provide a safety breakaway feature that can prevent damage to components of the bed system 100 when external pressures are applied to the bed system 100. Therefore, when a certain amount of external pressure or force, which could otherwise break or otherwise damage the hose 106 and other associated components in the bed system, is applied to the hose 106 or other components that are directly or indirectly connected to the hose 106, the hose 106 can automatically detach from or snap out of the hose retainer 120. Therefore, damage from such external pressure or force can be avoided to the hose 106, the hose retainer 120, and/or other components of the bed system 100.

The hose retainer 120, which is fitted to the end of the hose 106, can be coupled to the attachment plate 122 to secure the air duct system 150 to the modular thermal engine 124, as described below. In some implementations, the hose retainer 120 is configured to be pushed toward and snapped into the attachment plate 122. In other implementations, the hose retainer 120 can be moved laterally relative to the attachment plate 122, slid into place on the attachment plate 122, and retained in place via locking tabs on the attachment plate 122.

The attachment plate 122, which can also be referred to herein as an adapter or retainer, can be a coupling structure for attaching the modular thermal engine 124 to the foundation 104. This coupling structure can provide a toolless connection interface configured to couple the thermal engine 124 to the foundation 104 without requiring a tool. The attachment plate 122 can be made of a plastic material. The attachment plate 122 can be mounted to the first foundation surface 130 (e.g., the top surface of the foundation 104). The attachment plate 122 includes an opening 312 that is aligned with a foundation aperture 160 of the foundation 104 when the attachment plate 122 is fixed to the first foundation surface 130 of the foundation 104. As described herein, the opening 312 of the attachment plate 122 is also aligned with an air vent 318 of the thermal engine 124. Further, the opening 312 of the attachment plate 122 can be sized to receive the air duct hose 106 extending from the distribution layer 123, such that the air duct hose 106 extending from the distribution layer 123 can be in fluid communication with the thermal engine 124 through the opening 312 of the attachment plate 122, the foundation aperture 160 of the foundation 104, and the air vent 318 of the thermal engine 124.

As shown in FIG. 1, the thermal engine 124 can include a case 314 (e.g., housing). The case 314 can define a cavity for housing components of a fan assembly or other thermal module. The case 314 can be made of a plastic material. The thermal engine 124 can be removably attached to the foundation 104 such that the engine 124 can be easily interchangeable and/or replaced. A user can use a household tool or item, such as a butter knife or flathead screwdriver, to separate or detach the attachment plate 122 from the engine 124, thereby removing the thermal engine 124 from the foundation 104. A user can, for example, remove the modular thermal engine 124 to put a different thermal engine, such as a thermal engine of the same or different model, therein. Such a different thermal engine can be attached to the foundation 104 in the same manner described herein, for example, by snapping the case 314 of the different thermal engine to the attachment plate 122. The case 314 can also be attached to the attachment plate 122 using other latching mechanisms, including but not limited to sliding, rotating, and/or threading the case 314 onto the attachment plate 122.

Moreover, since the case 314 can be easily detached from the attachment plate 122, the thermal engine 124 can be attached to different types of foundations and different versions of foundations having the foundation aperture 160 and/or air duct hose 106 as described throughout this disclosure. In some implementations, the foundation 104 can include two thermal engines 124 for the left and right sides of the bed system 100, respectively. Each thermal engine can be used to selectively modify and control microclimates of the thermal engine's respective side of the bed system 100. This can be beneficial when the bed system 100 is utilized by two sleepers. In some implementations, as shown in FIG. 1, the foundation 104 can include one thermal engine 124. The one thermal engine can be used to modify and control microclimates of both sides of the bed system 100.

Figure 8:
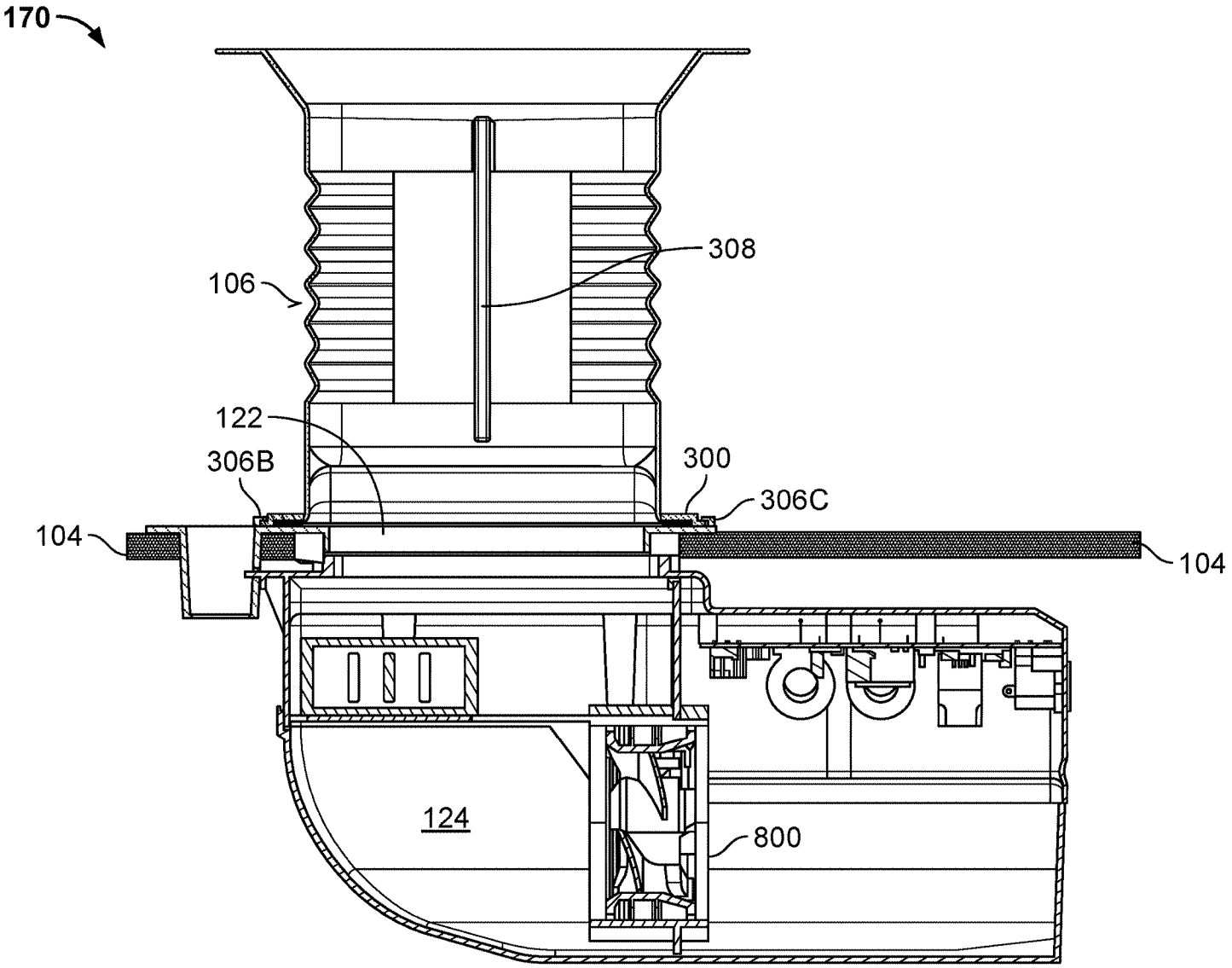
FIG. 8 is a cross sectional side view of the air duct system of FIG. 7 attached to the modular air controller having components therein.
Figure 11:
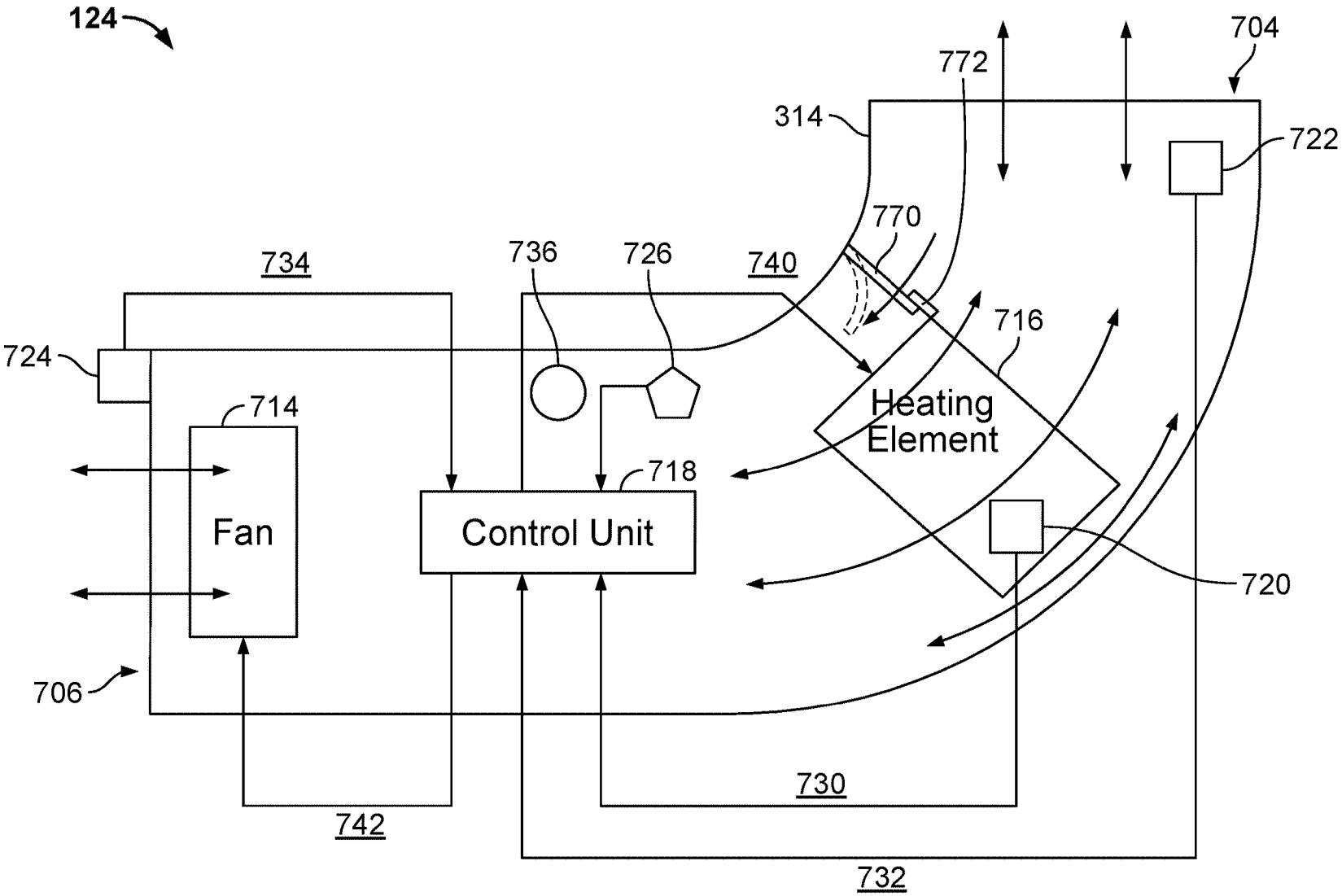
FIG. 11 is a diagram of an example control of the modular air controller.

In some implementations, as shown in reference to FIG. 8 and FIG. 11, the thermal engine 124 can include various components that are configured to move air into or from an airflow layer or other layers in the bed system 100. For example, the thermal engine 124 can include a fan assembly configured to draw air from the airflow layer (e.g., intermediate layer) of the mattress, and/or supply ambient or conditioned air to the airflow layer via the air duct system 150. In addition, one or more components in the thermal engine 124 can be configured to condition air before supplying it to the airflow layer or other layers in the mattress via the air duct system 150. For example, components in the thermal engine 124 can operate to heat or cool air and cause the heated or cooled air to flow into the airflow layer.

Figure 2:
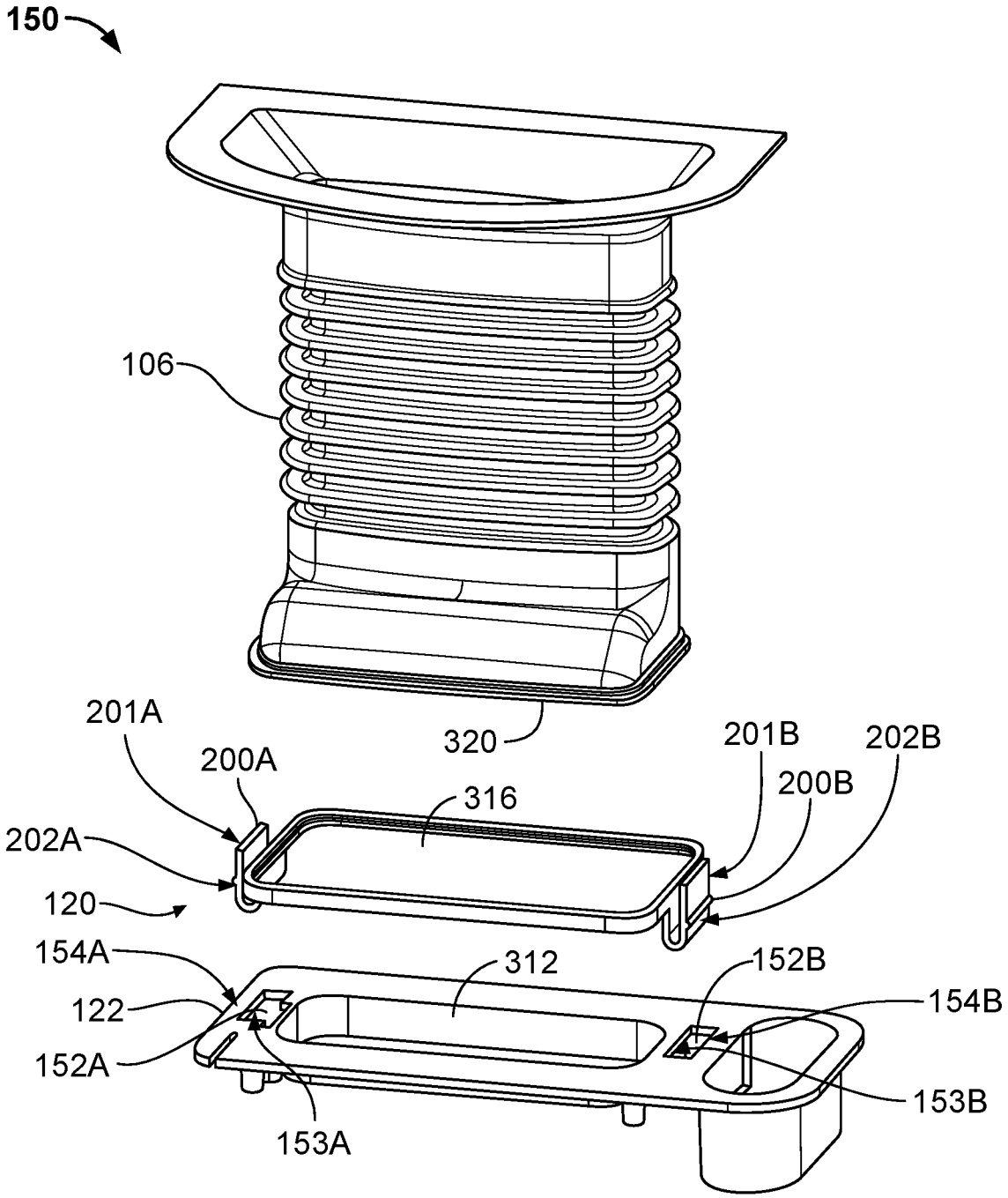
FIG. 2 is a perspective view of components of the air duct system.
Figure 3:
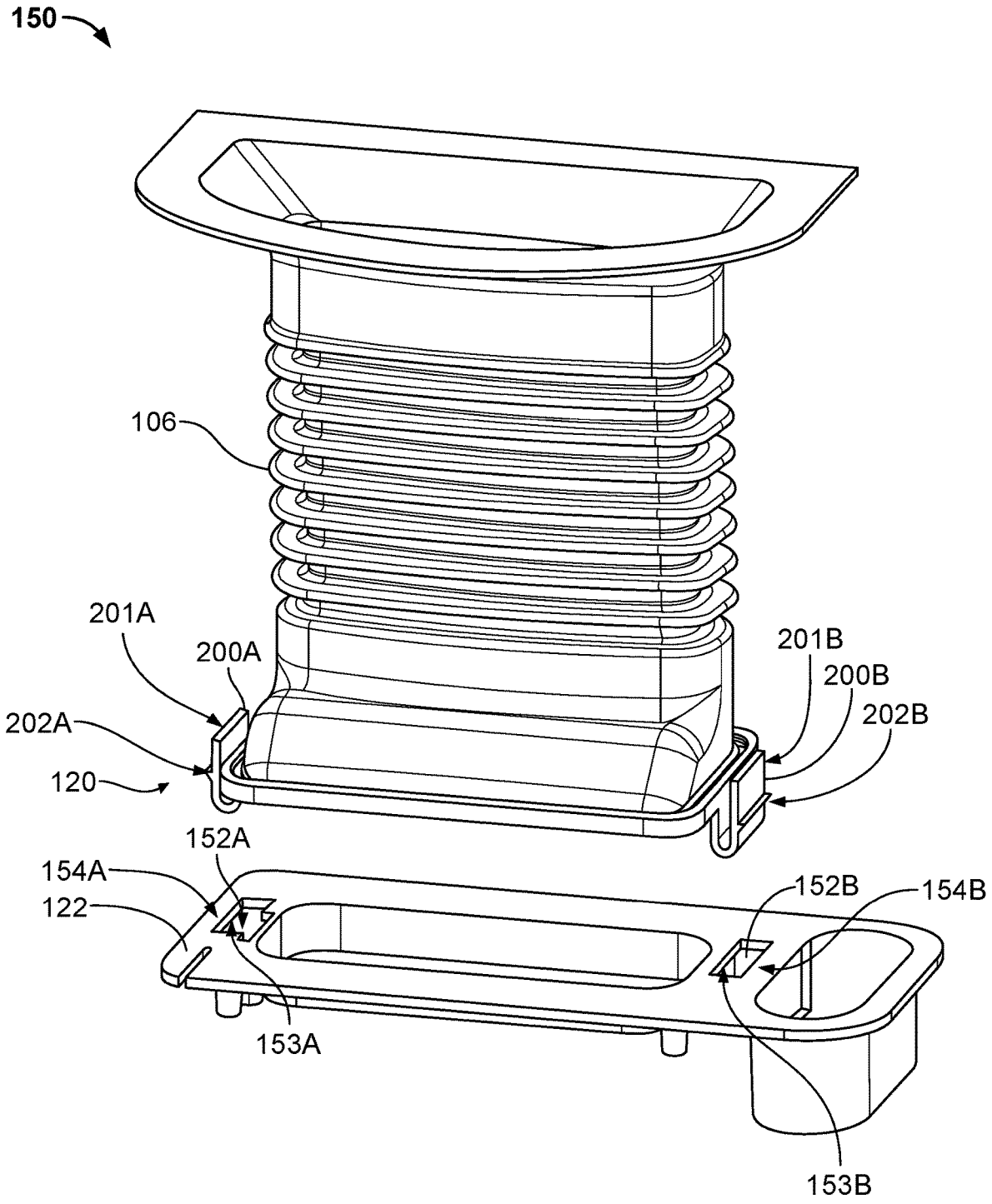
FIG. 3 is another perspective view of components of the air duct system.
Figure 4:
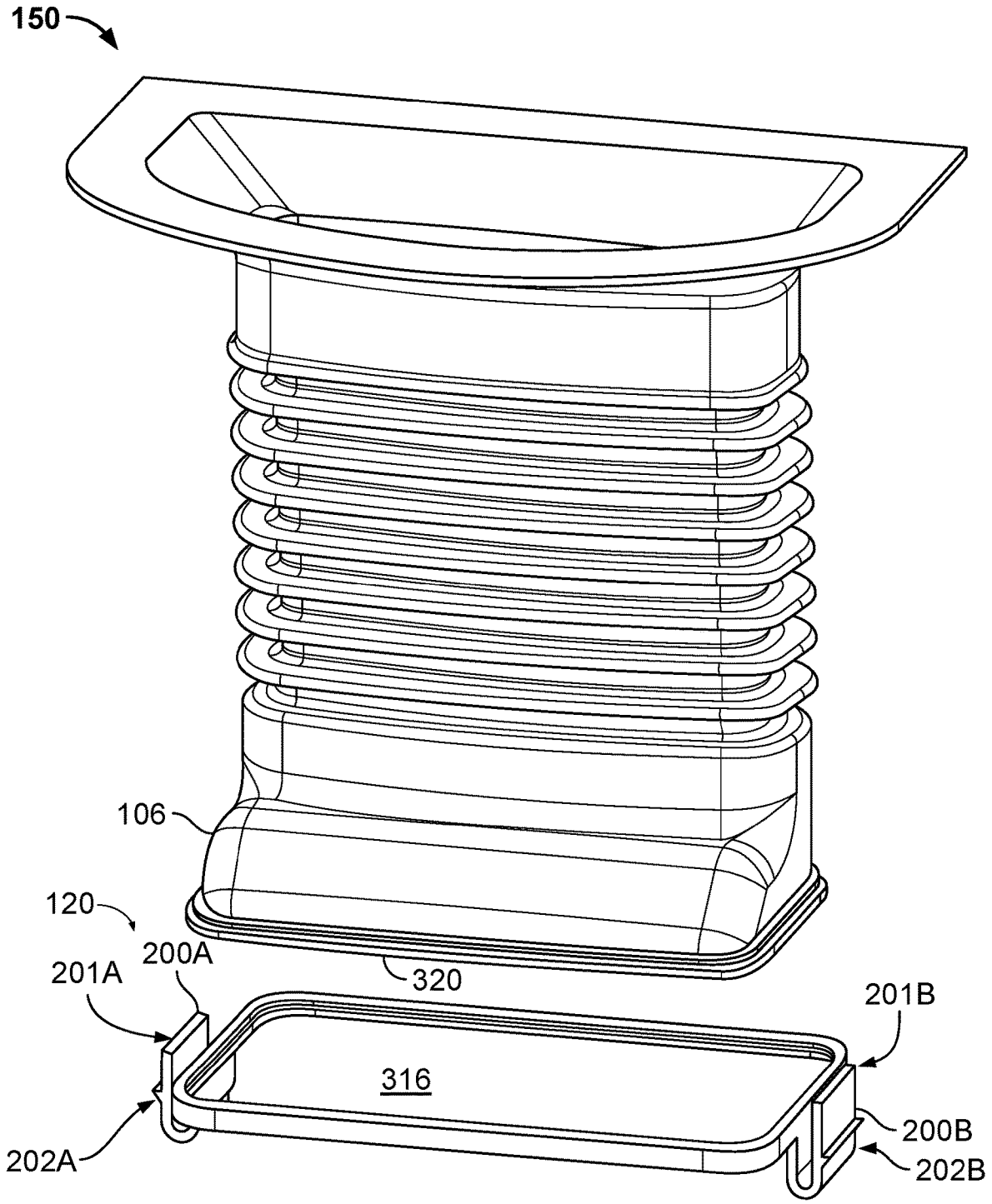
FIG. 4 is another perspective view of the air duct hose and the hose retainer of the air duct system.

FIG. 2 is a perspective exploded view of components of the air duct system 150. FIG. 3 is a perspective view of the components of the air duct system 150 that are partially assembled with each other. FIG. 4 is a perspective view of the air duct hose 106 and the hose retainer 120 of the air duct system 150, which are separated from each other. Referring to the FIGS. 2-4, the air duct hose 106 can be removably attached to the hose retainer 120. The hose retainer 120 can be removably attached to the attachment plate 122 to secure the air duct system 150 to the thermal engine 124, and fluidly connect the air duct system 150 to the thermal engine 124, described throughout this disclosure. As shown in FIG. 3, the air duct hose 106 is attached or otherwise coupled to the hose retainer 120, and the hose retainer 120 can be plugged in the attachment plate 122, as described in more detail below. In FIG. 4, the air duct hose 106 is removed or otherwise detached from the hose retainer 120. As described herein, the air duct hose 106 can be automatically disengaged or decoupled from the hose retainer 120 when a certain amount of force is applied to the hose 106, the hose retainer 120, or other associated bed components, which could break, tear, or otherwise damage the hose 106, the hose retainer 120, the attachment plate 122, the thermal module, the foundation, and/or other bed components.

As described throughout this disclosure, the hose 106 can be made of a material having a relatively high flexibility. For example, the hose 106 can be made of a flexible, silicone material. The hose retainer 120 can be made of a material having a relatively low flexibility. For example, the hose retainer 120 can be made of a plastic material that is more rigid (or less flexible) than the hose 106. The attachment mechanism between the hose 106 and the hose retainer 120 can provide for the breakaway feature described throughout this disclosure. For example, when unexpected external pressure is applied to the bed, the flexible hose 106 can snap off of the more rigid hose retainer 120 before damage can occur to any of the components of the bed.

The hose 106 can be attached to the hose retainer 120 in various different ways. In some implementations, the hose 106 can be captured or received inside the hose retainer 120. This configuration can be advantageous when the air duct hose 106 is a high durometer (e.g., stiff). Since the hose 106 can be flexible silicone, the hose 106 can be easily snapped out from the more rigid hose retainer 120 when unexpected pressure, weight, or force is applied to the hose 106 or other components of the bed system.

In some implementations, the hose 106 can be stretched over a protruding feature of the hose retainer 120. This configuration can be advantageous when the air duct hose 106 is a low durometer (e.g., less stiff, more elastic). Stretching the hose 106 over the protruding feature of the hose retainer 120 can also provide the breakaway feature described above. After all, when unexpected pressure, force, or weight is applied to the bed, the hose 106 can release or pop off of the protruding feature of the hose retainer 120, thereby causing the hose 106 to detach from the hose retainer 120. As a result, damage can be avoided to components of the bed, such as the hose 106. An example of the protruding feature of the hose retainer 120 is described herein in more detail, for example with reference to FIG. 6.

Figure 5:
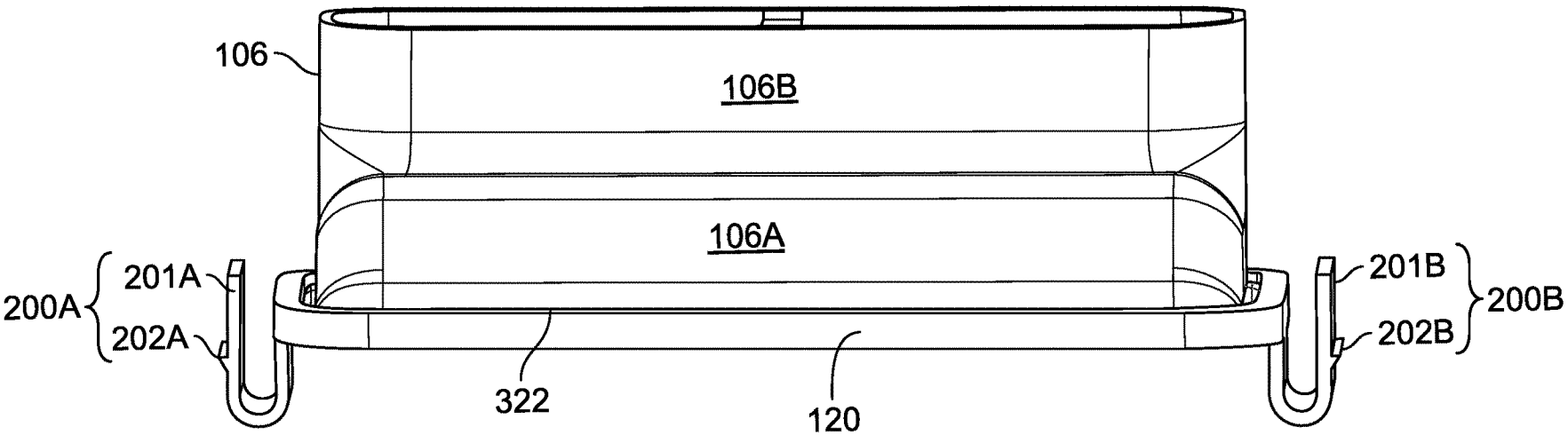
FIG. 5 is a side view of a portion of the air duct hose attached to the hose retainer of the air duct system.

Still referring to FIGS. 2-4, the hose retainer 120 can attach to the attachment plate 122 via snaps 200A-B (e.g., refer to FIG. 5). The snaps 200A-B can be received in openings 152A-B of the attachment plate 122. For example, the snaps 200A-B are flexed as they are pushed into the openings 152A-B and return to their original shapes so as to engage with respective portions of the attachment plate 122 that surrounds the openings 152A-B. To separate the hose retainer 200 from the attachment plate 122, the snaps 200A-B can be disengaged by pushing in on locking tabs of the snaps 200A-B and lifting the hose retainer 120 and/or the air duct hose 106 away from the attachment plate 122. An example of the coupling mechanism between the hose retainer 120 and the attachment plate 122 is further described herein, for example in reference to FIG. 5. Other coupling mechanisms are described with reference to FIGS. 12-16, which provide alternative means for coupling the air duct hose 106 to the attachment plate 122 (e.g., using engagement tabs 1022A and 1022B). For example, the air duct hose 106 can be attached to the attachment plate 122 using U-shaped clips (e.g., the engagement tabs 1022A and 1022B). These U-shaped clips can allow for easier attachment that is more intuitive to use by a user or technician, should they have to attach, detach, or reattach the air duct hose 106 and/or a plenum coupled to the air duct hose 106.

As illustrated in FIG. 2, the hose retainer 120 can include an opening 316. The opening 316 can be the same size as an opening 320 of the air duct hose 106. The opening 316 can also be the same size as the opening 312 of the attachment plate 122. In some implementations, the opening 316 can be slightly larger than the opening 312 of the attachment plate 122. Therefore, when the snaps 200A-B are received in the openings 152A-B of the attachment plate 122, the hose retainer 120 can sit on top of the attachment plate 122 such that the opening 316 can extend around the opening 312 of the attachment plate 122.

When the air duct hose 106 is attached to the hose retainer 120 and the hose retainer 120 is attached to the attachment plate 122, the air duct hose 106 can be in fluid communication with the modular thermal engine 124 described herein. Thus, the opening 312 of the attachment plate 122 can be the same size as the opening 320 of the air duct hose 106 to optimize airflow from the thermal engine 124, through the air duct hose 106, and around one or more layers of the mattress. In other implementations, the opening 312 of the attachment plate 122 can be larger or smaller than the opening 320 of the air duct hose 106, and/or can be larger or smaller than the opening 316 of the hose retainer 120.

FIG. 5 is a side view of a portion of the air duct hose 106 attached to the hose retainer 120 of the air duct system described herein. The air duct hose 106 can include a plurality of ribs 106A-N. In the example of FIG. 5, rib 106A is at a bottom end 322 of the air duct hose 106 and is received in the hose retainer 120. As described above, the air duct hose 106 can be removably attached to the hose retainer 120. The air duct hose 106 can easily break away (e.g., snap off) from the hose retainer 120 when significant or unexpected pressure or weight is applied to the bed system. In some implementations, the hose retainer 120 can be integrated with the rib 106A of the air duct hose 106.

The snaps 200A-B of the hose retainer 120 can be received by the openings 152A-B of the attachment plate 122 (e.g., refer to FIGS. 2-4). Each of the snaps 200A-B can include locking tabs 201A-B (e.g., spring tabs, levers) and hooks 202A-B. The locking tabs 201A-B can be injection-molded to the hose retainer 120. The air duct hose 106 can be attached to the attachment plate 122 via snap installation of the snaps 200A-B, which can allow for quick and easy connection and disconnection of the air duct hose 106. Moreover, with the snaps 200A-B, the air duct hose 106 can be removed from the attachment plate 122 of the thermal engine 124 without using tools, making it easy and intuitive for any user to remove, change, and/or replace components such as the hose 106.

Referring to the FIGS. 2-5, the snaps 200A-B can be easily received by the openings 152A-B of the attachment plate 122. A user can direct and push the snaps 200A-B down into the openings 152A-B to snap the hose retainer 120 in place with the attachment plate 122. In some implementations, as the snaps 200A-B are received into the openings 152A-B of the attachment plate 122, lower portions of the locking tabs 201A-B pass through the openings 152A-B until the hooks 202A-B contact respective surfaces 153A-B of the attachment plate 122 that partially defines or faces the openings 152A-B. The surfaces 153A-B can be defined along the thickness of the attachment plate 122 around the openings 152A-B. While the hooks 200A-B contact the surfaces 153A-B of the attachment plate 122, the snaps 200A-B are flexed against the surfaces 153A-B so that the hose retainer 120 can be further pushed toward the attachment plate 122. When the hooks 200A-B pass the surfaces 153A-B, the snaps 200A-B are flexed back to their original shapes, so that stopper portions 154A-B of the attachment plate 122 engage the hooks 200A-B of the snaps 200A-B and prevent the hose retainer 120 from being disengaged from the attachment plate 122. As illustrated in FIG. 3, the stopper portions 154A-B can be portions of the attachment plate 122 adjacent the surfaces 153A-B of the attachment plate 122, respectively.

To remove or detach the hose retainer 120 from the attachment plate 122, the user can press inwards (e.g., towards the air duct hose 106) on the locking tabs 201A-B, which causes the hooks 202A-B to disengage from the stopper portions 154A-B of the attachment plate 122 around the openings 152A-B of the attachment plate 122. While the locking tabs 201A-B are flexed in, the user can then pull the hose retainer 120 and/or the air duct hose 106 out from the attachment plate 122.

Figure 6:
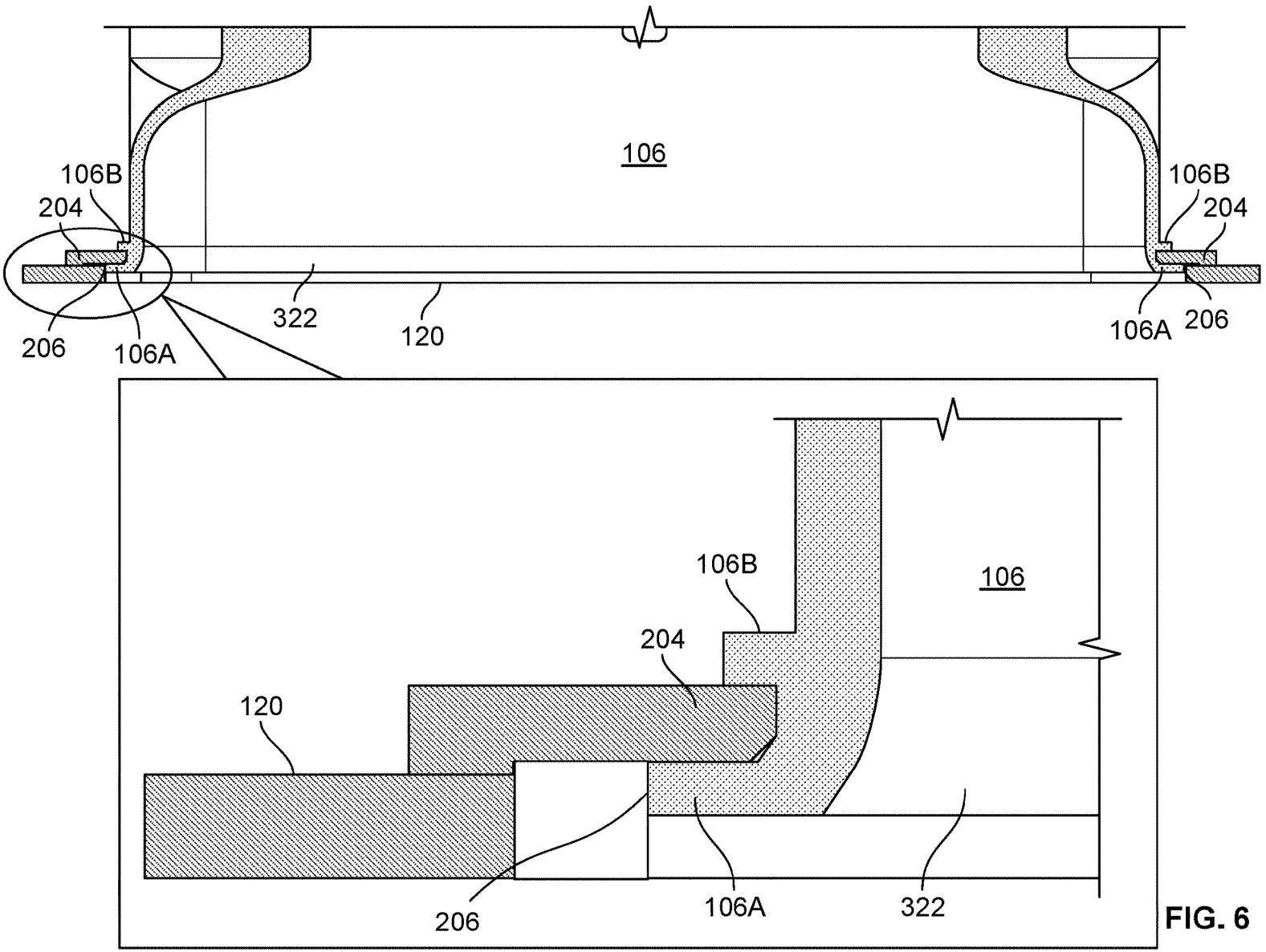
FIG. 6 is a side view of the air duct hose attached to the hose retainer of the air duct system.

FIG. 6 is a side view of an example breakaway mechanism between the air duct hose 106 and the hose retainer 120 of the air duct system. As mentioned, the breakaway feature is facilitated by a specially-designed hose fitting. In particular, the hose 106 made of a first, relatively-more flexible material (e.g., silicone) can be fitted to the hose retainer 120 made of a second, relatively-less flexible material (e.g., plastic), and the hose retainer 120 is configured to attach the hose 106 to a component of the bed. The hose retainer 120 can be configured to allow the hose 106 to slip out of the hose retainer 120 with a certain amount of force pulling the hose 106 away from the hose retainer 120. Such slip-out feature can be advantageous to improve performance and retention of the air duct system to one or more components, such as the thermal engine, without causing degradation to any of such components after a breakaway event may occur. Therefore, after the breakaway event, components such as the hose retainer 120 or a foundation may not have to be replaced.

The air duct hose 106 includes the ribs 106A-B that can extend around a periphery of an end of the air duct hose 106. The hose retainer 120 can snap in between the two ribs 106A and 106B of the air duct hose 106 at the bottom end 322 of the hose 106. The hose retainer 120 includes an engagement portion 206 formed with an overhang edge 204, which can define the opening of 316 of the hose retainer 120. The bottom rib 106A can be inserted into a space defined by the engagement portion 206, wherein the overhang edge 204 maintains the bottom rib 106A within the space. In other words, the bottom rib 106A is disposed under the overhang edge 204. The top rib 106B can secure above the overhang edge 204 to retain the hose retainer 120 with the hose 106. The bottom rib 106A can act as a main rib that controls a breakaway force.

As a result of this configuration, the breakaway feature can be controllable. By pulling up on the air duct hose 106, the ribs 106A-B can disengage from the hose retainer 120. The air duct hose 106 can be easily popped out of the hose retainer 106 to avoid causing damage to any other components of the bed system, such as a fan assembly in the thermal engine 124. Thus, components of the bed system may also be less prone to breakage under unforeseen circumstances and/or loads due to the flexibility of the materials, attachment, and components described herein.

In some implementations, the breakaway feature can also be achieved using clips (e.g., plastic clips). For example, clips are used to couple the air duct hose to the hose retainer, and can release the coupling if a certain degree of force (e.g., a force that pulls the air duct hose from the hose retainer) is applied to the clips.

Figure 7:
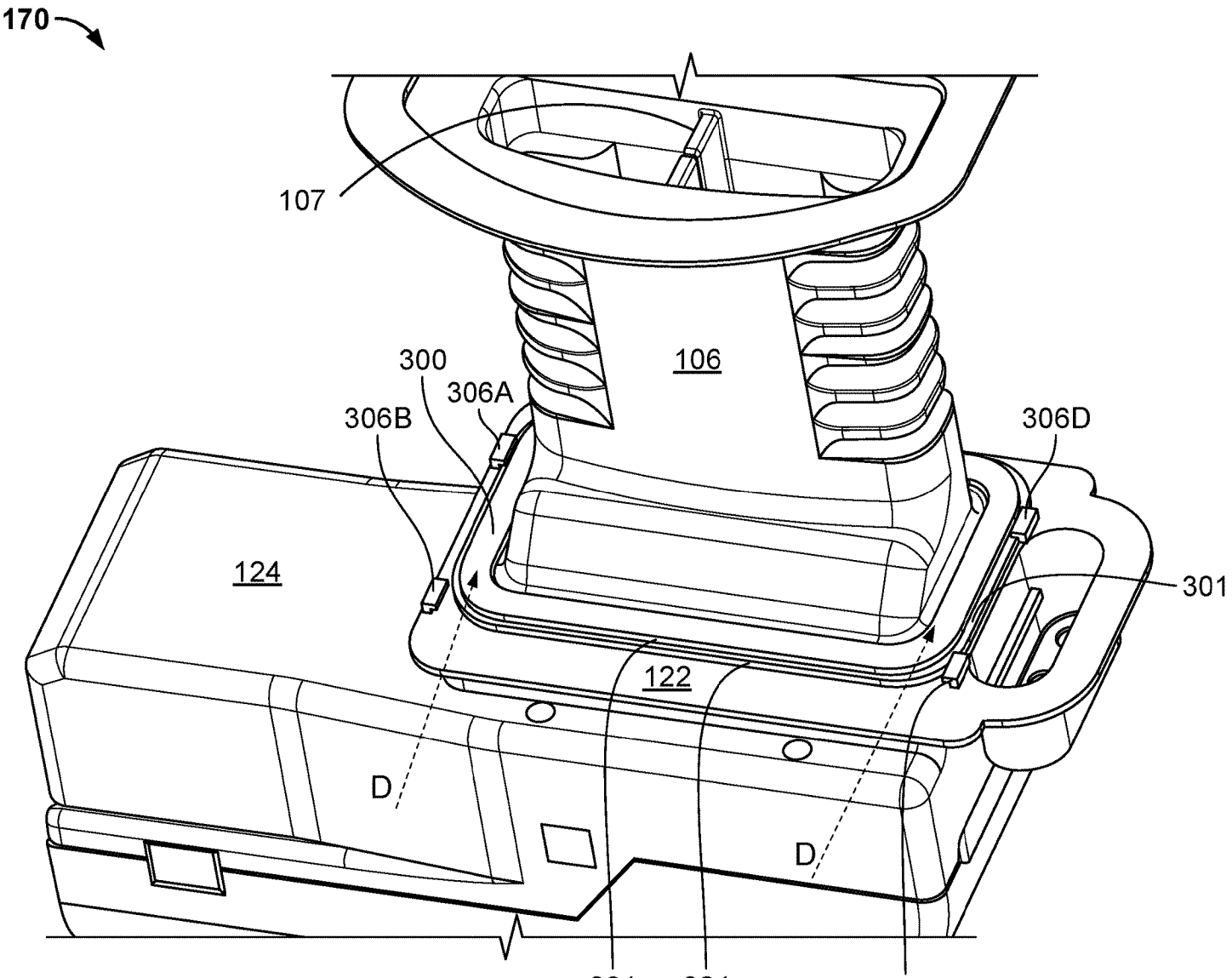
FIG. 7 is another example air duct system attached to a modular air controller.

FIG. 7 illustrates another example air duct system 170 attached to the thermal engine 124. The air duct system 170 can include the air duct hose 106, as described above. The air duct system 170 can also include a hose adapter 300. The hose adapter 300 can be configured similarly to the hose retainer 120 except for the mechanism (e.g., a slide-lock mechanism) for coupling the adapter 300 to the attachment plate 122. In some implementations, the hose adapter 300 can be removably attached to the air duct hose 106, using the techniques described herein with respect to the hose retainer 120. In some implementations, the air duct hose 106 can be integrated with the hose adapter 300 so that the hose adapter 300 is part of the air duct hose 106 rather than a removable component of the air duct system 170.

Similarly to the hose retainer 120, the hose adapter 300 can be used to attach the air duct system 170 to the thermal engine 124 at the foundation of the bed system. The hose adapter 300 can attach to the attachment plate 122 using a slide-lock mechanism. The hose adapter 300 can slide into position on the attachment plate 122 in a lateral direction D that is generally parallel with the top surface of the attachment plate 122 or the top surface of the foundation to which the attachment plate 122 is fixed. Sliding the hose adapter 300 into place on top of the attachment plate 122 can provide feedback of a positive connection between the air duct system 170 and the thermal engine 124. Once the hose adapter 300 is slid into place on the attachment plate 122, the hose adapter 300 can be held in place by friction.

In addition, the hose adapter 300 can also be held in place by engagement with stoppers 306A-D (e.g., slide lock retainers) that protrude from the attachment plate 122. In some implementations, the hose adapter 300 can include a recessed edge 301 along a bottom flange 324 of the hose adapter 300 to retain the air duct system 170 to the thermal engine 124. The stoppers 306A-D can be positioned at corners or along edges of the attachment plate 122 and configured to align with the recessed edge 301 when the hose adapter 300 is slid onto the attachment plate 122. Once the stoppers 306A-D are aligned with the recessed edge 301, the stoppers 306A-D are configured to press the recessed edge 301 against the top surface of the attachment plate 122 so that the hose adapter 300 can be held in place and prevented from sliding off of the attachment plate 122.

Moreover, as shown in FIG. 7, the air duct hose 106 includes a center rib 107. The rib 107 can include two extended profiles that run down a center of the hose 106. The center rib 107 can provide structural support to the air duct hose 106 without interfering with air flow through the air duct hose 106. Without this rib 107, the hose 106 can collapse when other mattress components push against the hose 106, thereby restricting or stopping air flow through the hose 106. The center rib 107 therefore helps maintain clearance through the air duct hose 106. Even if the two profiles of the center rib 107 meet in the middle shift or are offset so that they allow for the hose 106 to compress by, for example, up to 50%, sufficient air flow may still be maintained through the air duct hose 106.

FIG. 8 is a cross sectional side view of the air duct system 170 of FIG. 7 attached to the thermal engine 124 having components therein. The thermal engine 124 can house components such as heating and cooling units, fans 800, wiring, motors, and/or thermal engine controller(s) (e.g., refer to FIG. 11). Moreover, as shown in FIG. 8, the air duct hose 106 can include an anti-collapse rib 308. For example, the rib 308 can be positioned down a center of the air duct hose 106 to prevent the walls of the hose 106 from collapsing. Therefore, airflow may not be impacted when external pressures are applied to the bed system. The rib 308 can maintain a structure of the hose 106 to prevent damage that can be caused by the external pressures to components of the bed system.

Figure 9:
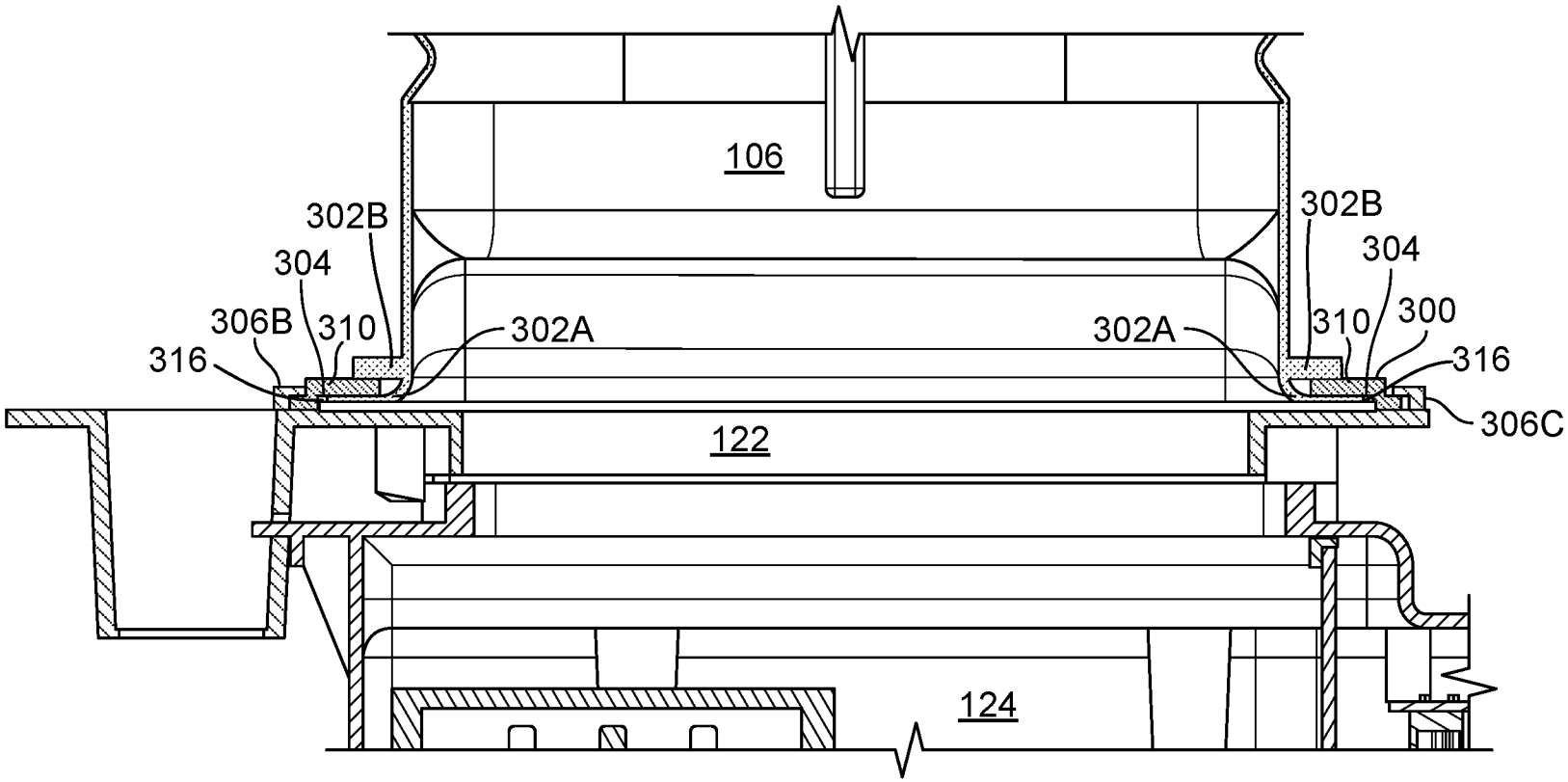
FIG. 9 is a close up cross sectional side view of the air duct system of FIG. 7 attached to the modular air controller.

FIG. 9 is a close up cross sectional side view of the air duct system of FIG. 7 attached to the thermal engine 124. Similar to the hose retainer 120 in FIG. 6, the hose adapter 300 can fit around a bottom rib 302A of the air duct hose 106. The hose adapter 300 can include engagement portion 304 formed with an overhang edge 310, which can define the opening 316 of the hose retainer 120. As mentioned, the bottom rib 302A can be inserted into a space defined by the engagement portion 304, wherein the overhang edge 310 maintains the bottom rib 302A within the space. In other words, the bottom rib 302A is disposed under the overhang edge 310. The top rib 302B can secure above the overhand edge 310 to retain the hose retainer 120 with the hose 106. The bottom rib 302A can act as a main rib that controls a breakaway force.

Figure 10:
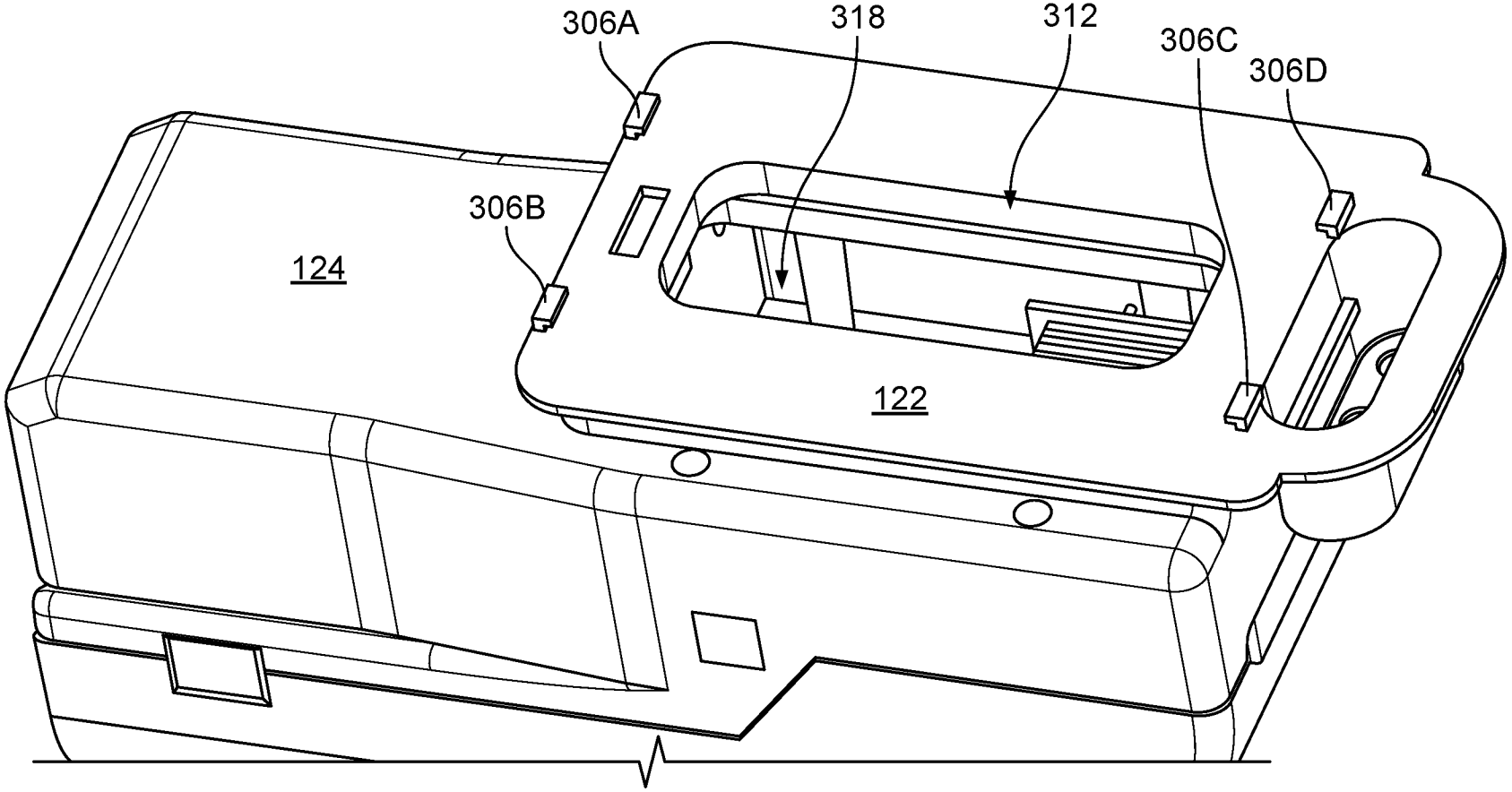
FIG. 10 is a perspective view of the modular air controller with the attachment plate that receives the air duct system of FIG. 7.

FIG. 10 is a perspective view of the thermal engine 124 with the attachment plate 122 that receives the air duct system of FIG. 7. As depicted, the attachment plate 122 defines the opening 312. When the air duct system of FIG. 7 is attached to the attachment plate 122, air can flow through the thermal engine 124, through the air vent 318 of the thermal engine 124, through the opening 312 of the attachment plate 122, and through the air duct hose 106 to be distributed to an airflow layer/intermediate layer of the mattress in the bed system. In some implementations, the openings 312 and/or 318 can be sized differently for left and right sides of the bed system to enable different airflow schemes (e.g., airflow rates, directions, areas, etc.) in different sides of the bed system. The opening 312 can also be sized differently based on a size of the air duct hose 106. For example, the opening 312 can be a same size as an opening of the air duct hose 106 to optimize airflow through the hose 106.

FIG. 11 is a diagram of an example control of the modular thermal engine 124. The thermal engine 124 can include a fan assembly 714 mounted in the case 314 (e.g., housing) and configured to cause air to flow through the case 314. In some implementations, the fan assembly 714 is configured as a reversible fan assembly configured to cause air to flow in opposite directions. For example, the fan assembly 714 can be operated to rotate a fan in one direction to cause air to flow from an ambient side 706 to a connection side 704 (e.g., the air vent 318) of the case 314. Further, the fan assembly 714 can be operated to rotate the fan in the opposite direction to cause air to flow from the connection side 704 to the ambient side 706 of the case 314. In some implementations, the fan assembly 714 is positioned at the ambient side 706 of the case 314 as illustrated. Other locations of the fan assembly 714 are possible in other implementations, such as the fan assembly 800 illustrated in FIG. 8. For example, the fan assembly 714 can be positioned adjacent a heating element 716, such as between the heating element 716 and a PCB board (e.g., a control unit 718).

The thermal engine 124 can include a heating element 716 mounted in the case 314 and configured to heat air that passes through the heating element 716. In some implementations, the heating element 716 includes a plurality of fins that allow air flow in between the fins to be heated by the heating element. As described herein, the heating element 716 can be mounted in the case 314 in a location that is at least partially spaced from an inner wall of the case 314 so as to define a bypass flow path that allows air to flow around the heating element 716 while air simultaneously flows through the heating element 716. Such a bypass flow path can allow effective air flow through the housing when air is drawn from the mattress and flows from the connection-side opening 708 to the ambient-side opening 710, or when air is supplied and flows from the ambient-side opening 710 toward the connection-side opening 708 with or without activating the heating element 716.

The thermal engine 124 can include a control unit 718 mounted in the case 314 and configured to control one or more components in the thermal engine 124 in one or more operational modes. For example, the control unit 718 can operate components in the thermal engine 124 in a first mode (e.g., ambient-air-drawing mode) in which the control unit 718 controls the fan assembly 714 to cause air to flow from the connection side 704 to the ambient side 706 so that air is drawn from the airflow layer of the mattress. Alternatively or in addition, the control unit 718 can operate components in the thermal engine 124 in a second mode (e.g., heating-air-supplying mode) in which the control unit 718 activates the heating element 716 and controls the fan assembly 714 to cause air to flow from the ambient side 706 to the connection side 704 so that the air passes through the heating element 716 and the heating air is supplied to the airflow layer of the mattress. Alternatively or in addition, the control unit 718 can operate components in the thermal engine 124 in a third mode (e.g., ambient-air-supplying mode) in which the control unit 718 controls the fan assembly 714 to cause air to flow from the ambient side 706 to the connection side 704 (without activating the heating element 716) so that ambient air is supplied to the airflow layer of the mattress.

In alternative embodiments, the thermal engine 124 can include a cooling unit with or without the heating element 716, so that the thermal engine 124 can be operated in additional operational modes. For example, the control unit 718 can operate components in the thermal engine 124 in a fourth mode (e.g., cooling-air-supplying mode) in which the control unit 718 activates the cooling element and controls the fan assembly 714 to cause air to flow from the ambient side 706 to the connection side 704 so that the air passes through the cooling element and the cooling air is supplied to the airflow layer of the mattress.

The thermal engine 124 can be configured with a printed circuit board. The printed circuit board can be positioned in the case 202 between the ambient-side opening 710 and the heating element 716. The fan assembly 714 can be positioned in the case 314 between the ambient-side opening 710 and the heating element 716. The thermal engine 124 can be electrically connected to the fan assembly 714 and the heating element 716 to control operation of the fan assembly 714 and the heating element 716.

The thermal engine 124 can include one or more temperature sensors configured to detect temperatures at different locations. For example, the thermal engine 124 can include a first temperature sensor 720 configured to detect a temperature of the heating element 716 and generate a sensor signal 730 representative of the heating element temperature. The air controller 700 can include a second temperature sensor 722 configured to detect an outlet temperature of air existing the case 314, such as a temperature of air existing at the connection side 704, and generate a sensor signal 732 representative of the outlet air temperature. The control unit 718 can receive the sensor signals 730 and 732 from the first and second temperature sensors 720 and 722, and control the heating element 716 based at least in part on the sensors signals 730 and 732 to achieve a predetermined outlet air temperature. For example, the control unit 718 can determine an offset value of the detected outlet air temperature from the predetermined outlet air temperature, and controls the heating element 716 to compensate the offset value so that the outlet air temperature reaches the predetermined outlet air temperature.

The second temperature sensor 722 can be used to detect a temperature of air drawn into the case 314 from, for example, the airflow layer of the mattress, and generate a sensor signal 732 representative of the drawn air temperature. Alternatively, the thermal engine 124 can include a separate temperature sensor (e.g., a third temperature sensor) for detecting the drawn air temperature. The thermal engine 124 can further include a fourth temperature sensor 724 configured to detect an ambient temperature and generate a sensor signal 734 representative of the ambient temperature. The control unit 718 can receive the sensor signals 732 and 734 from the second (or third) and fourth temperature sensors 722 and 724, and control the fan assembly 714 based at least in part on the sensors signals 732 and 734 to achieve a predetermined drawn air temperature. For example, the control unit 718 can determine an offset value of the detected drawn air temperature from the predetermined drawn air temperature, and controls the fan assembly 714 to compensate the offset value so that the drawn air temperature reaches the predetermined drawn air temperature. In addition, the control unit 718 can calculate an amount of heat extracted from the airflow layer of the mattress based on the sensor signals 732 and 734.

In addition, the thermal engine 124 can include one or more humidity sensors 726 configured to detect a humidity value and generate a sensor signal 736 representative of the humidity value. The control unit 718 can receive the sensor signal 736 and control the fan assembly 714 and/or the heating element 716 based in part on the sensor signal 736 to achieve a predetermined humidity value. For example, the control unit 718 can determine an offset value of the detected humidity value from the predetermined humidity value, and controls the fan assembly 714 and/or the heating element 716 to compensate the offset value so that the humidity reaches the predetermined humidity value.

Figure 12A:
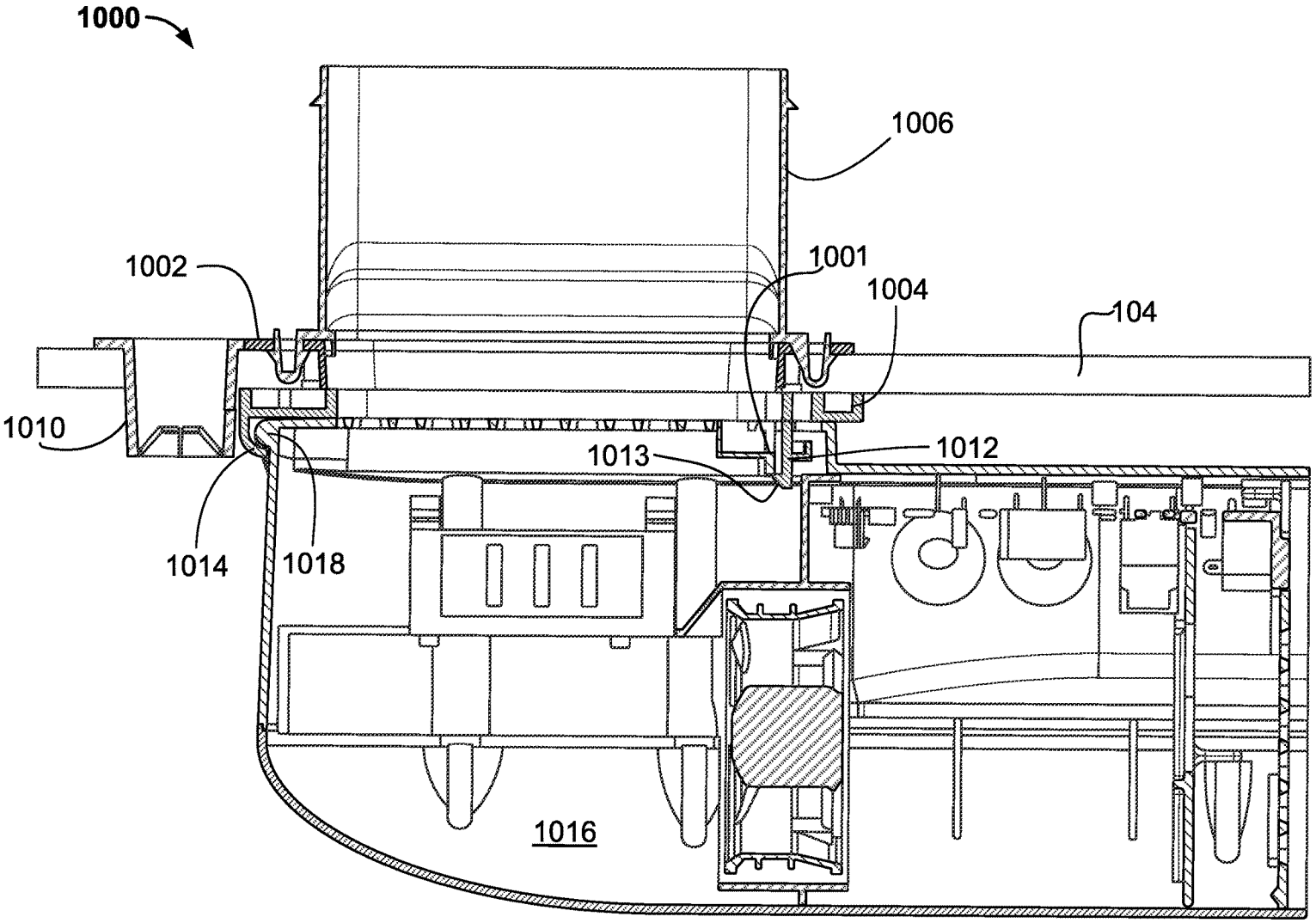
FIGS. 12A-B are cross sectional side views of another example air duct system attached to a modular air controller.
Figure 12B:
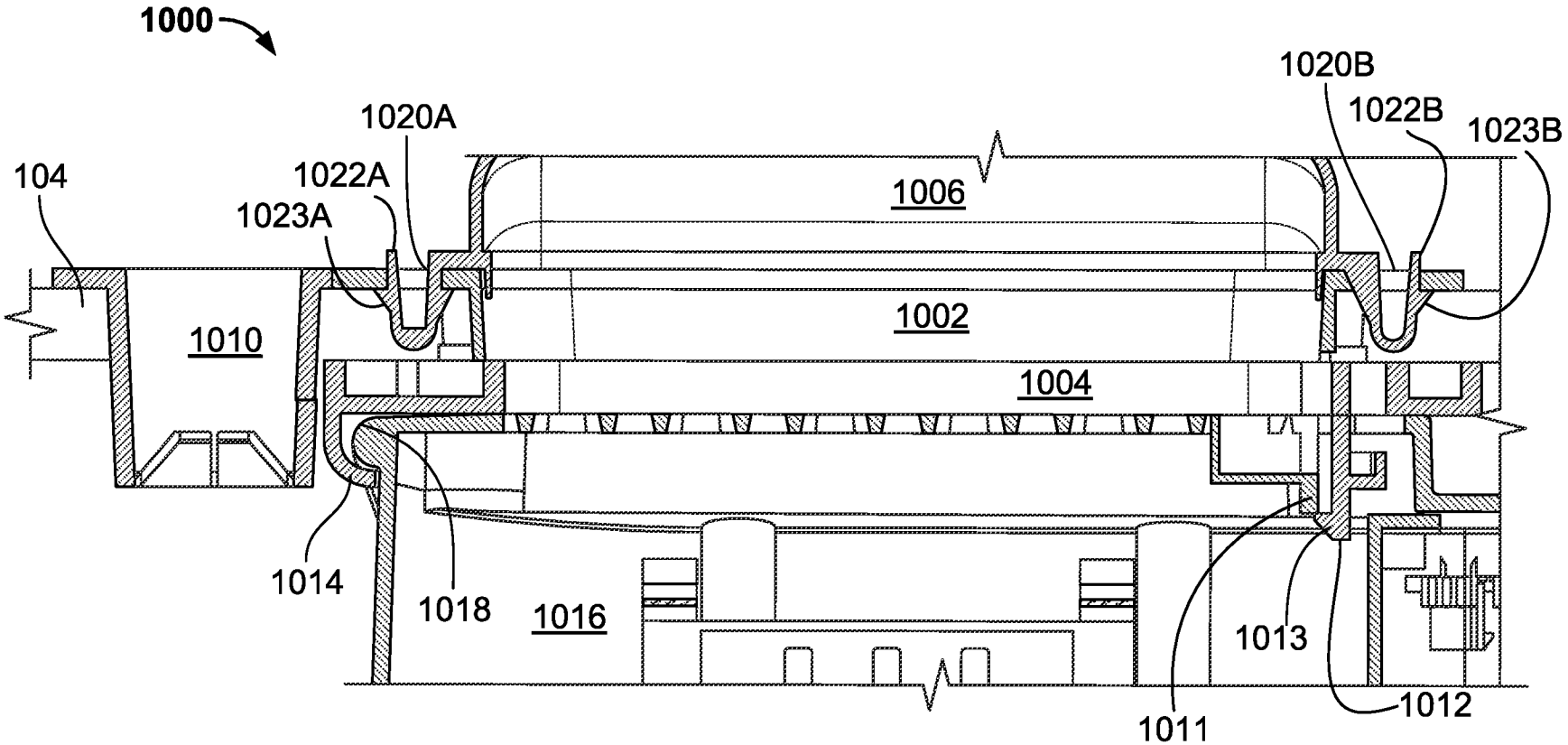

FIGS. 12A-B are cross sectional side views of another example air duct system 1000 attached to a modular air controller 1016 (also referred to as a thermal engine). FIG. 12A further depicts a plenum 1006 configured to be coupled to an air duct hose (e.g., the air duct hose 106 described above) extending from the mattress (e.g., the air distribution layer 123). Similar to the thermal engine 124 described herein, the thermal engine 1016 is attached to the foundation 104 using a toolless connection interface. In some implementations, the toolless connection interface includes a first attachment plate 1002 and a second attachment plate 1004. The first attachment plate 1002 can be attached to one side of the foundation 104 (e.g., the top surface of the foundation 104), and the second attachment plate 1004 can be attached to the opposite side of the foundation 104 (e.g., the bottom surface of the foundation 104). The first and second attachment plates 1002 and 1004 can be coupled to each other so that the first and second attachment plates 1002 and 1004 are secured to the foundation 104. The first and second attachment plates 1002 and 1004 can be coupled to each other in various methods, such as by interference fitting (e.g., via connectors 1032A-N and corresponding receivers 1030A-N, described below with reference to FIGS. 14A-B), by fasteners (e.g., screws), or other suitable coupling mechanisms.

The first attachment plate 1002 has a structure that removably couples the plenum 1006 at the top of the foundation 104. The second attachment plate 1004 has a structure that removably couples the thermal engine 1016 at the bottom of the foundation 104. For example, the thermal engine 1016 has a case that can be removably engaged (e.g., snapped) to the second attachment plate 1004, as further described below. The thermal engine 1016 can house one or more components, as described herein (e.g., a fan).

In some implementations, as depicted in FIG. 12A, the plenum 1006 can snap onto the first attachment plate 1002. The thermal engine 1016 is attached to the second attachment plate 1004. The toolless connection interface in this example can provide various advantages because the first and second attachment plates 1002 and 1004 are separately provided and engaged at the opposite sides of the foundation 104, respectively. For example, the first and second attachment plates 1002 and 1004 can be secured to various foundations having different thicknesses, without modifications or adaptations to such different foundations. This is because the first and second attachment plates 1002 and 1004 can simply be placed at the opposite sides of the foundation 104 and coupled to each other through an opening defined through the thickness of the foundations.

In some implementations, the first attachment plate 1002 includes a retaining cup 1010. The retaining cup 1010 can hold wires that can be used by one or more components of the thermal engine 1016 and/or other components of the bed system described throughout this disclosure.

Figure 14A:
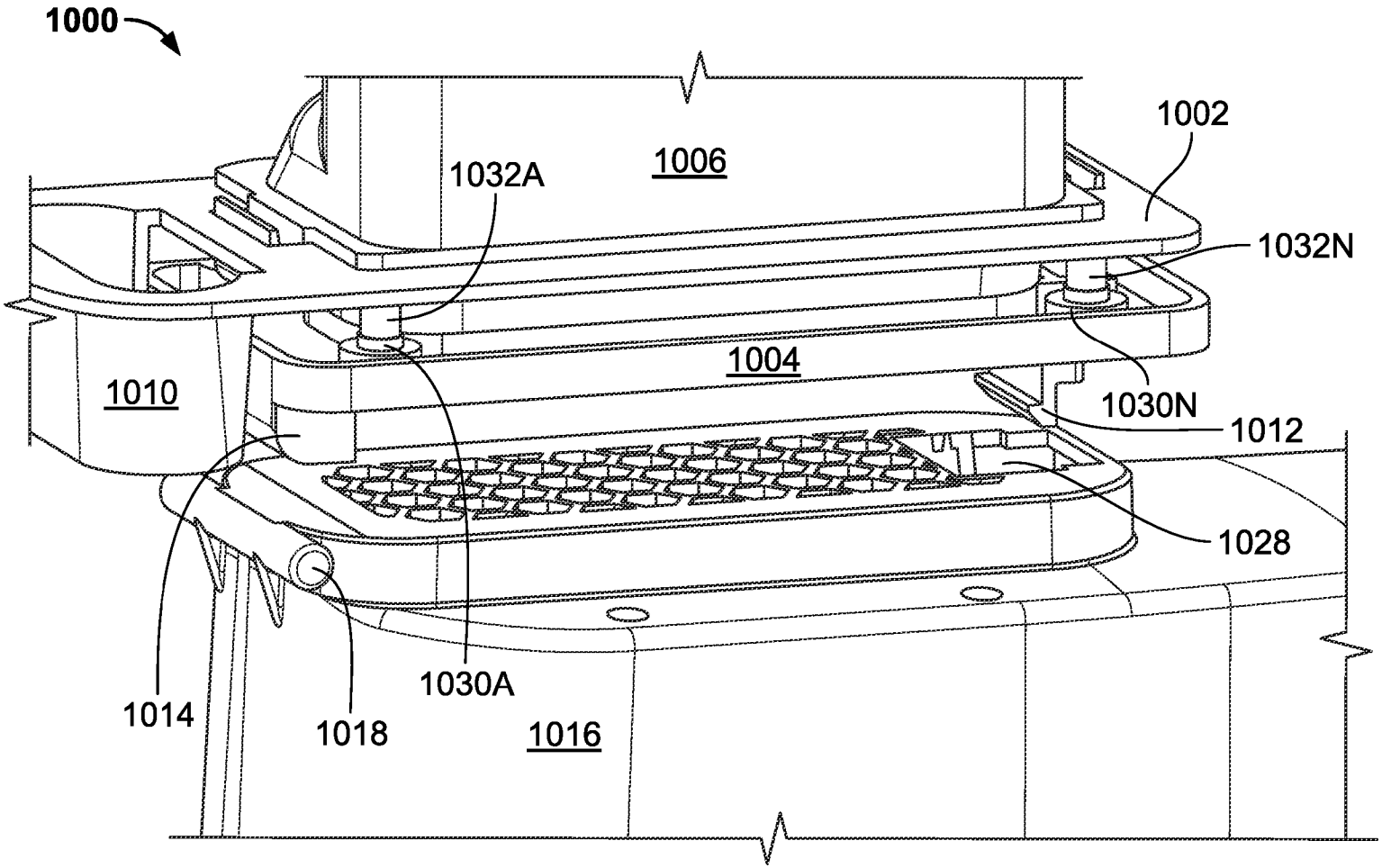
FIG. 14A is a perspective view of the modular air controller of FIGS. 12A-B.

Similarly to the attachment plate 122, the second attachment plate 1004 provides a toolless interface for removably coupling the thermal engine 1016. For example, the second attachment plate 1004 includes a locking tab 1012, which is structurally and functionally similar to the locking tabs 201A and 201B of the attachment plate 122. The locking tab 1012 of the second attachment plate 1004 includes a snapping end 1013. Once the locking tab 1012 is snapped into place and engages with the engagement portion 1011 of the thermal engine 1016, the thermal module 1016 can be retained to the second attachment plate 1004. As illustrated in FIG. 14A, the thermal engine 1016 can include an opening 1028 that receives the locking tab 1012 therethrough.

In some implementations, the second attachment plate 1004 includes a receiving cup 1014. The receiving cup 1014 is configured to receive a pivot bar 1018 of the thermal engine 1016. The receiving cup 1014 can be used to secure the second attachment plate 1004 to the thermal engine 1016 by engaging the pivot bar 1018 of the thermal engine 1016.

Accordingly, to retain the first and second attachment plates 1002 and 1004 to the thermal engine 1016, the receiving cup 1014 can be snapped or otherwise fitted around the pivot bar 1018 while the locking tab 1012 can be inserted into an opening in the thermal engine 1016 (e.g., the opening 1028 in FIG. 14A) and retained by the engagement portion 1011 of the thermal engine 1016. The receiving cup 1014 can be made of a flexible material that allows for easier and simpler engagement and disengagement of the second attachment plate 1004 from the thermal engine 1016. To remove the first and second attachment plates 1002 and 1004 from the thermal engine 1016, a tool (e.g., a blunt butter knife, a flathead screw driver, or any suitable tool or item having an extended tip) can be used to disengage the locking tab 1012 (e.g., the snapping end 1013 thereof) from the engagement portion 1011 of the thermal engine 1016. The pivot bar 1018 can then be separated (e.g., removed) from the receiving cup 1014 in order to fully separate the first and second attachment plates 1002 and 1004 from the thermal engine 1016.

In other implementations, a tool may not be required to separate the first and second attachment plates 1002 and 1004 from the thermal engine 1016. For example, the receiving cup 1014 can be made of a material having relatively higher flexibility so that it can flex out and away from the thermal engine 1016 (e.g., as the pivot bar 1018 is slid out or pulled out from the receiving cup 1014), thereby removing the pivot bar 1018 from being retained in the receiving cup 1014. As a result, a tool may not be required to flex out and remove the locking tab 1012 from the engagement portion 1011 of the thermal module 1016. Instead, by simply pulling the thermal engine 1016 away from the second attachment plate 1004, the pivot bar 1018 can be removed from the receiving cup 1014, and the locking tab 1012 can be disengaged from the engagement portion 1011 of the thermal engine 1016, thereby making it easier, simpler, and faster for a user to remove the thermal engine 1016 from the foundation 104.

FIG. 12B is another cross-sectional side view of the thermal engine 1016. Here, the plenum 1006 is shown with engagement tabs 1022A and 1022B on respective ends of the plenum 1006. The engagement tabs 1022A and 1022B can snap into openings 1020A and 1020B of the first attachment plate 1002. In some implementations, the engagement tabs 1022A and 1022B include flanges 1023A and 1023B that are configured to each engage with portions of the first attachment plate 1002 adjacent the openings 1020A and 1020B when the engagement tabs 1022A and 1022B are inserted and snapped into the openings 1020A and 1020B. Once engaged with the portions of the first attachment plate 1002, the flanges 1023A and 1023B function to restrict the engagement tabs 1022A and 1022B from sliding out from the openings 1020A and 1020B. To remove the plenum 1006 from the first attachment plate 1002, a portion of each of the engagement tabs 1022A and 1022B can be flexed away so that the flanges 1023A and 1023B are disengaged from the portions of the first attachment plate 1002, and then the engagement tabs 1022A and 1022B can be removed from the openings 1020A and 1020B of the first attachment plate 1002. This can be manually performed by a user or technician, for example by pressing or squeezing the engagement tabs 1022A and 1022B with thumbs and fingers.

In other implementations, a tool can be used to bend or flex the engagement tabs 1022A and 1022B towards the plenum 1006 to disengage an engagement portion (e.g., the flanges 1023A and 1023B) of each of the engagement tabs 1022A and 1022B from the respective openings 1020A and 1020B. In some implementations, a tool may not be required, and instead, a user can flex the engagement tabs 1022A and 1022B with their fingers to release the tabs 1022A and 1022B from the openings 1020A and 1020B. The user can then lift the plenum 1006 up to fully disengage the plenum 1006 from the first attachment plate 1002.

Figure 13:
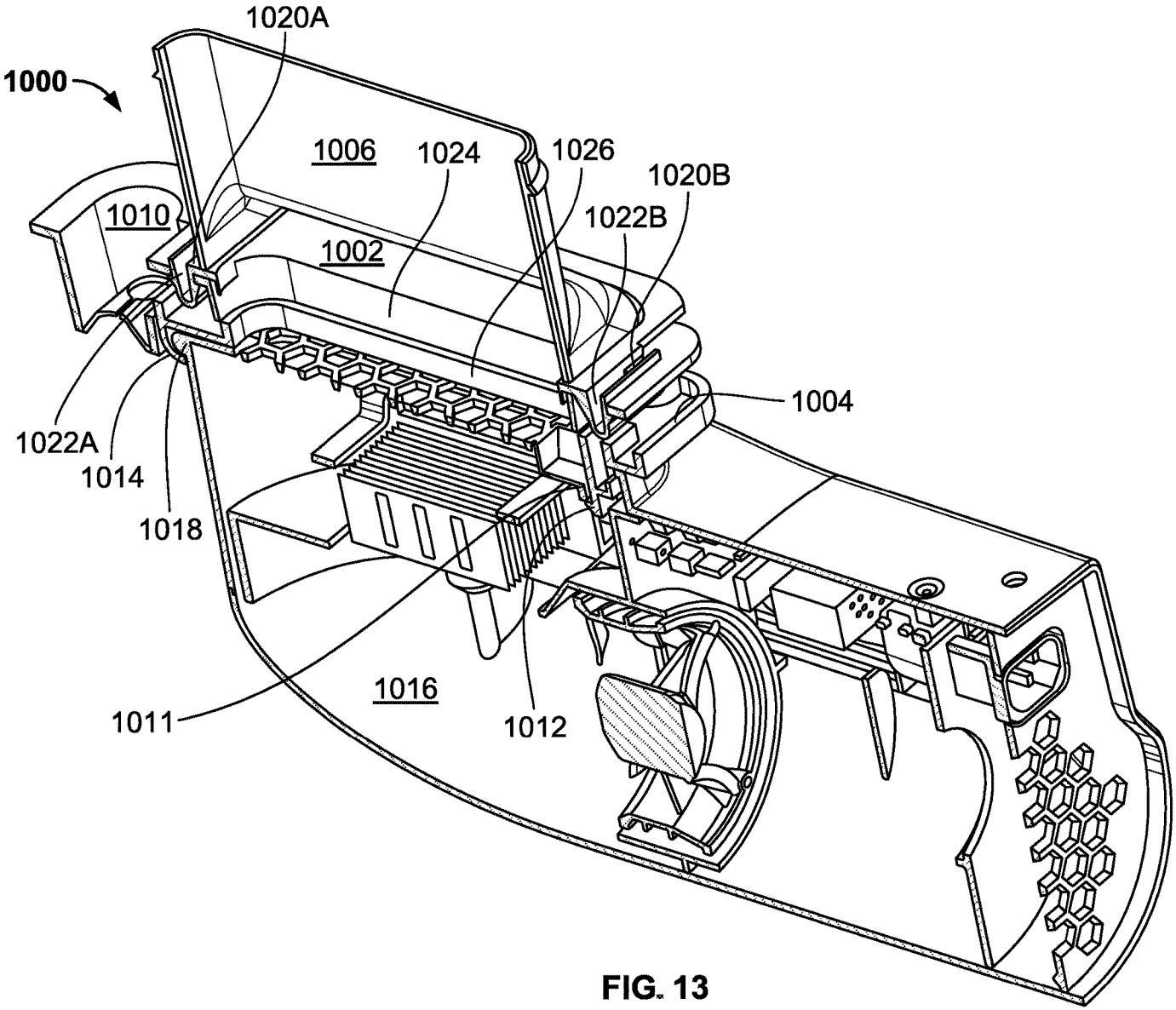
FIG. 13 is a perspective cross sectional view of the modular air controller of FIGS. 12A-B.

FIG. 13 is a perspective cross sectional view of the modular air controller 1000 of FIGS. 12A-B. As shown, the first attachment plate 1002 defines an opening 1024 that lines up with an opening 1026 of the second attachment plate 1004. The openings 1024 and 1026 can be same or similar sizes in order to provide a desired amount of airflow from the thermal engine 1016 into the bed system through the plenum 1006 and an air duct hose connected between the plenum 1006 and the bed system.

As described above, to remove the thermal engine 1016 from the foundation, the plenum 1006 can first be detached from the first attachment plate 1002. A user can press the engagement tabs 1022A and 1022B towards the plenum 1006 to release flanges of the engagement tabs 1022A and 1022B (e.g., refer to flanges 1023A and 1023B in FIG. 16) from the respective openings 1020A and 1020B in the first attachment plate 1002. The user can then lift the plenum 1006 up, in an opposite direction from the thermal engine 1016 in order to detach the plenum 1006 from the first attachment plate 1002. Next, a tool (e.g., blunt butter knife) can be inserted into the opening 1020B and used to disengage the locking tab 1012 from the engagement portion 1011 of the thermal engine 1016. Once the locking tab 1012 is released from the engagement portion 1011 of the thermal engine 1016, the pivot bar 1018 of the thermal engine 1016 can be removed from the receiving cup 1014 of the second attachment plate 1004.

FIG. 14A is a perspective view of the modular air controller 1000 of FIGS. 12A-B. In this Figure, the foundation 104 is removed while the first and second attachment plates 1002 and 1004 are coupled to each other. The first attachment plate 1002 can include engagement connectors 1032A-N (e.g., protrusions, columns, or other longitudinal shapes) that engage with receivers 1030A-N (e.g., holes, channels, hollows, etc.) of the second attachment plate 1004. The engagement connectors 1032A-N can be positioned at the first attachment plate 1002 to align with the receivers 1030A-N of the second attachment plate 1004. In some implementations, the engagement connectors 1032A-N and the receivers 1030A-N can be configured at each corner of the first and second attachment plates 1002 and 1004, respectively. In some implementations, the engagement connectors 1032A-N and the receivers 1030A-N can be located at different positions along perimeters of the first and second attachment plates 1002 and 1004. In some implementations, the engagement connectors 1032A-N can be configured to interference fit with the receivers 1030A-N. Thus, when the engagement connectors 1032A-N are inserted into the receivers 1030A-N, the first attachment plate 1002 can be coupled to the second attachment plate 1004. Thus, a user, installer, or technician can easily and quickly align the engagement connectors 1032A-N with the receivers 1030A-N and snap the first and second attachment plates 1002 and 1004 together by fitting the aligned engagement connectors 1032A-N into the receivers 1030A-N.

Figure 14B:
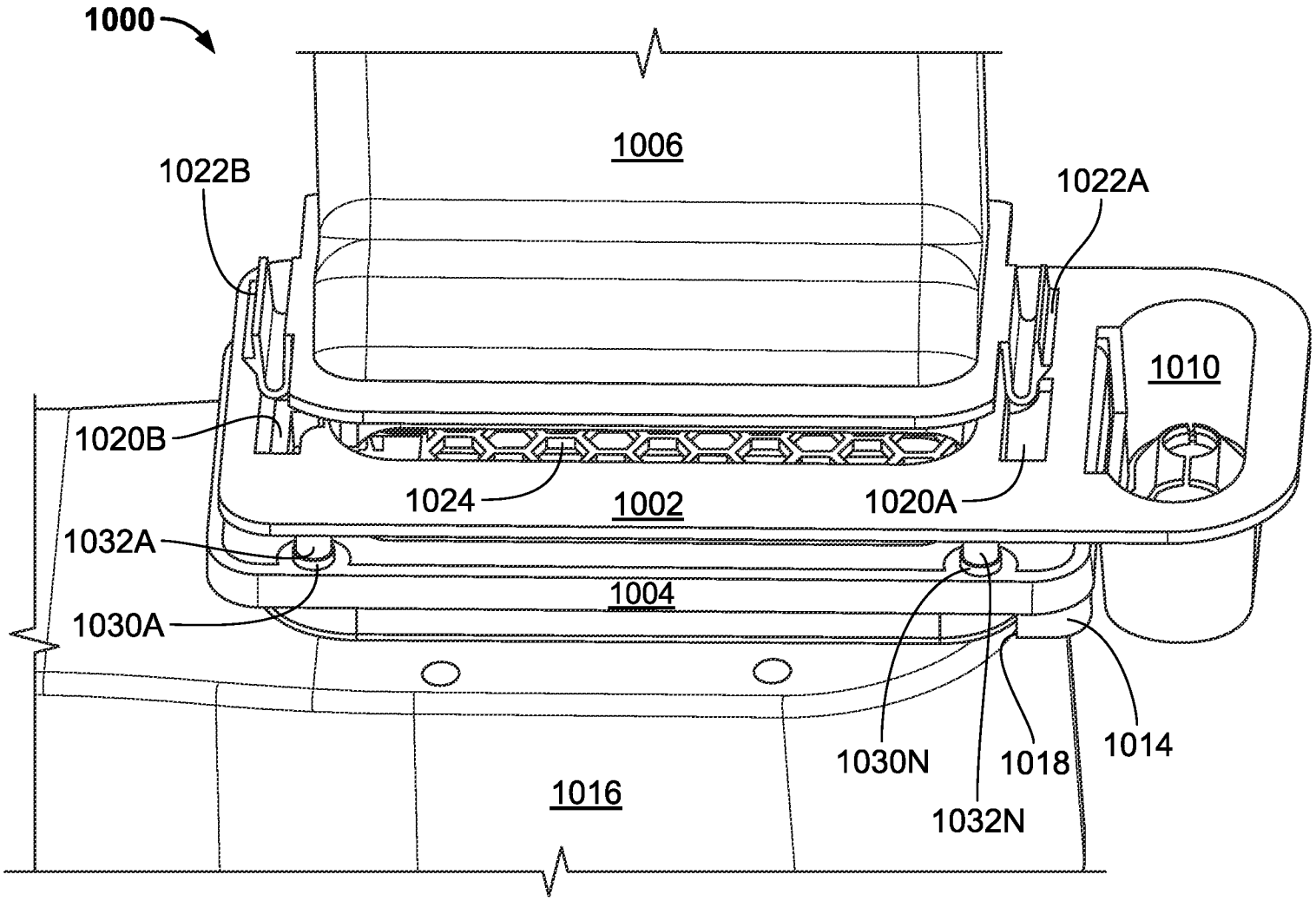
FIG. 14B is another perspective view of the modular air controller of FIGS. 12A-B.

In some implementations, the engagement connectors 1032A-N can be plastic tube-like connectors or protrusions of the first attachment plate 1002. The engagement connectors 1032A-N can also be screws, bolts, or other similar fastening mechanisms that can be received by the receivers 1030A-N and configured to retain the first attachment plate 1002 to the second attachment plate 1004. To detach the first attachment plate 1002 from the second attachment plate 1004, the user can simply pry the engagement connectors 1032A-N out of the receivers 1030A-N, without a tool, by pulling the first attachment plate 1002 in a direction opposite the second attachment plate 1004. In other implementations, the engagement connectors 1032A-N and the receivers 1030A-N can be configured to receive fastening elements (e.g., screws) that can fasten the engagement connectors 1032A-N with the receivers 1030A-N FIG. 14B is another perspective view of the modular air controller 1000 of FIGS. 12A-B. As depicted, the first attachment plate 1002 connects to the second attachment plate 1004 via the engagement connectors 1032A-N and the receivers 1030A-N. The engagement tabs 1022A and 1022B of the plenum 1006 also snap and fit into the openings 1020A and 1020B of the first attachment plate 1002. When the plenum 1006 is retained to the first attachment plate 1002, air from components housed in the thermal engine 1016 can flow up through the opening 1024 of the first attachment plate 1002 and into the plenum 1006 to be delivered through a hose that circulate the air throughout the bed system. Alternatively, the thermal engine 1016 can operate to flow air in the opposite direction where air is drawn from the bed system through the hose, the plenum and into the thermal engine 1016.

Figure 15:
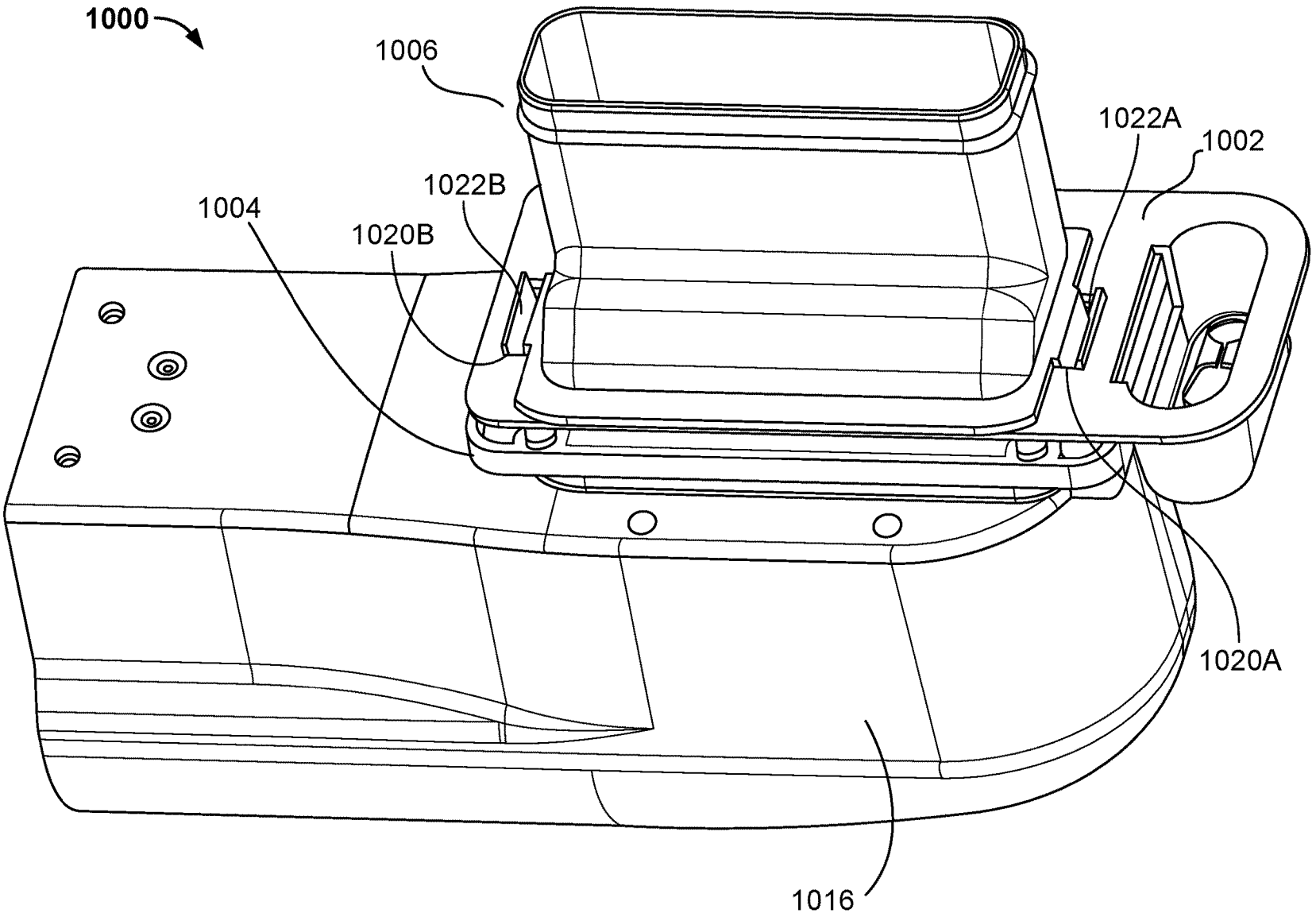
FIG. 15 is another perspective view of the air duct system of FIGS. 12A-B.

FIG. 15 is another perspective view of the air duct system 1000 of FIGS. 12A-B. As shown here, the plenum 1006 is retained to the first attachment plate 1002 when the engagement tabs 1022A and 1022B are snapped and fitted into the openings 1020A and 1020B of the first attachment plate 1002. The first attachment plate 1002 is retained to the second attachment plate 1004 and the second attachment plate 1004 is retained to the thermal engine 1016 as previously described (e.g., refer to FIGS. 12-14).

Figure 16:
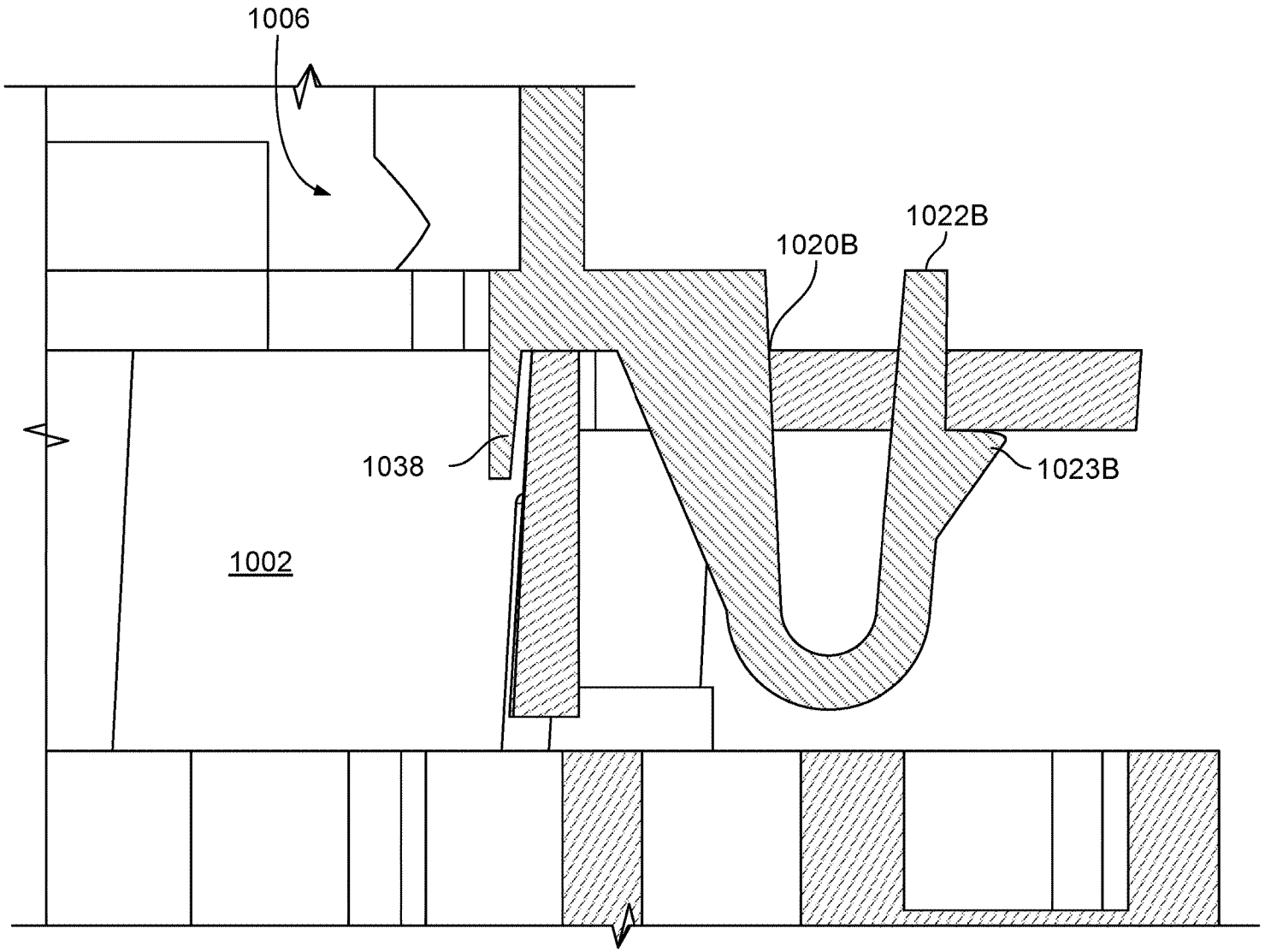
FIG. 16 is an expanded side cross sectional view of a plenum coupled to a first attachment plate of FIGS. 12A-B.

FIG. 16 is an expanded side cross sectional view of a plenum 1006 coupled to a first attachment plate 1002 of FIGS. 12A-B. As depicted and described above, the engagement tab 1022B is integrated into and part of the plenum 1006. The engagement tab 1022B is configured to be biased to flex out to maintain its U-shape. Thus, when the engagement tab 1022B is squeezed to become closer to the body of the plenum 1006, the engagement tab 1022B resists the squeezing action and return to its original U-shape when it is released from the action. The engagement tab 1022B fits into the opening 1020B of the first attachment plate 1002 and snaps into place when the flange 1023B of the engagement tab 1022B engages with a portion of the first attachment plate 1002 adjacent the opening 1020B. Once engaged with the portion of the first attachment plate 1002, the flange 1023B functions to restrict the engagement tab 1022B from sliding out from the opening 1020B. Although not depicted in FIG. 16, the plenum 1006 also includes the engagement tab 1022A with a respective flange that is configured to snap and fit into the opening 1020A of the first attachment plate 1002. The plenum 1006 may also include an alignment flange 1038 that can be received in the opening 1020B of the first attachment plate 1002 and used to help align the plenum 1006 with the first attachment plate 1002.

Figure 17:
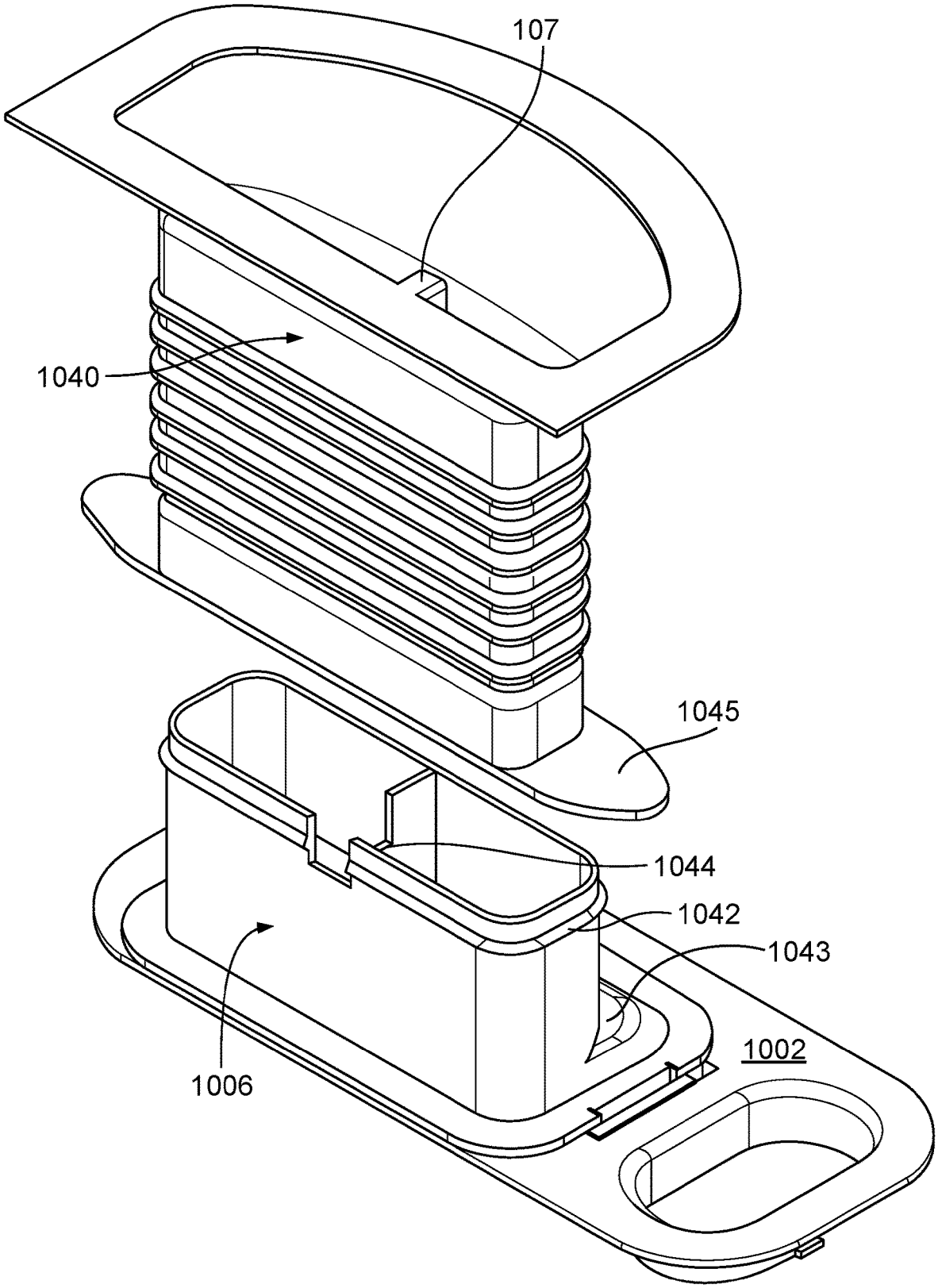
FIG. 17 is a partial exploded, perspective view of the first attachment plate, the plenum, and an air duct hose.

FIG. 17 is a partial exploded, perspective view of the first attachment plate 1002, the plenum 1006, and an air duct hose 1040. As depicted and described above, the plenum 1006 is coupled to the first attachment plate 1002 via a snap fit mechanism. The snap fit mechanism makes attachment and detachment of the plenum 1006 to the first attachment plate 1002 both user friendly and intuitive. The plenum 1006 includes a ridge 1042 that extends around a perimeter of the plenum 1006. The ridge 1042 can be used to retain an air duct hose 1040 to the plenum 1006. The ridge 1042 can be advantageous to allow for a breakaway function in which the air duct hose 1040 can easily snap off of the plenum 1006 if and when too much weight is applied to components of the air duct system and/or the bed system. Because of this breakaway function, components of the air duct system, such as the plenum 1006 and the air duct hose 1040, may not be destroyed or damaged when too much weight or pressure is applied to the bed system.

The air duct hose 1040 can attach to the plenum 1006 by sliding over (e.g., stretching over) the plenum 1006. In some implementations, the air duct hose 1006 may not stretch over the entire plenum 1006 and instead may stretch over a portion of the plenum 1006, such as up to and around just the ridge 1042. In other implementations, the air duct hose 1006 may stretch over the entire plenum 1006. One or more ribs of the air duct hose 1040 can be retained by the ridge 1042. Therefore, the ridge 1042 can act as a stopper that keeps the air duct hose 1040 attached to the plenum 1006 so as to prevent the hose 1040 from slipping off the plenum 1006. To remove the air duct hose 1040 from the plenum 1006, a user or technician can simply pull the air duct hose 1040 in a direction opposite the plenum 1006 with a force exceeding a certain threshold, thereby lifting (e.g., sliding) the air duct hose 1040 off of the plenum 1006. In some implementations, the air duct hose 1040 can be a predetermined length such that the air duct hose 1040 exhibits a pre-stretched or pre-tension condition. The predetermined length can ensure that the air duct hose 1040 compresses by a minimal amount when connected to the plenum 1006 and when weight, pressure, or movement is applied to the bed system. The minimal compression can be beneficial to optimize airflow through the air duct hose 1040. Additionally or alternatively, the plenum 1006 can be designed with a predetermined length that causes the air duct hose 1040 to maintain the pre-stretched condition and reduce or otherwise eliminate how much the air duct hose 1040 may compress when weight, pressure, or movement is applied to the bed system. As a result, the air duct hose 1040 may exhibit less tendency to collapse. Airflow through the air duct hose 1040 can therefore be optimized.

The air duct hose 1040 may include a rigid plate 1045. When the air duct hose 1040 slides over the plenum 1006, the plate 1045 can extend around a base of the plenum 1006, flush with a top surface of the attachment plate 1002. The rigid plate 1045 can provide support to the air duct hose 1040 such that it remains fluidly connected to the plenum 1006. The rigid plate 1045 can therefore provide support such that the air duct hose 1040 does not detach from the plenum 1006 when relatively little weight, pressure, or movement is applied to the bed system.

As described in reference to FIG. 7, the air duct hose 1040 includes a center rib 107. The rib 107 can include one extended profile that runs down a center of the hose 1040. In some implementations, the center rib 107 can include 2 extended profiles running down the center of the hose 1040. The center rib 107 can provide structural support to the air duct hose 1040 without interfering with air flow through the air duct hose 1040. Without this rib 107, the hose 1040 can collapse when other mattress components push against the hose 1040, thereby restricting or stopping air flow through the hose 1040. The center rib 107 therefore helps maintain clearance through the air duct hose 1040. In some implementations, even if the two profiles of the center rib 1040 meet in the middle shift or are offset so that they allow for the hose 1040 to compress by, for example, up to 50%, sufficient air flow may still be maintained through the air duct hose 1040.

The plenum 1006 includes a slot 1044 that is configured and shaped to receive a key 1046 (e.g., refer to FIG. 18) of the air duct hose 1040. The slot 1044 is advantageous to ensure that the plenum 1006 may not be flipped around and installed differently (e.g., in a different direction) on the first attachment plate 1002. Therefore, the plenum 1006 can be uniformly attached to the first attachment plate 1002 and facing a same direction regardless of the bed system and whether the thermal engine is installed on a right side or left side of the bed system. This makes it easier and more intuitive for any user or technician to simply attach the plenum 1006 to the first attachment plate 1002. As an example, the plenum 1006 can be attached to the first attachment plate such that a protruding boot portion 1043 of the plenum 1006 faces inwards towards a middle of the bed system instead of out towards an edge of the bed system. In some implementations, the protruding boot portion 1043 can have an additional rib to provide support and/or structure to the engagement tabs of the plenum 1006 (refer to engagement tabs 1022A and 1022B in FIGS. 12-16). The user or technician can then align the key 1046 of the air duct hose 1040 with the slot 1044 of the plenum 1006 in order to easily identify the appropriate direction for attaching and retaining the air duct hose 1040 to the plenum 1006.

The slot 1044 is positioned at a center or midline of the plenum 1006. The key 1046 can be located in a corresponding position inside the air duct hose 1040 such that the key 1046 aligns with and is received by the slot 1044.

Figure 18:
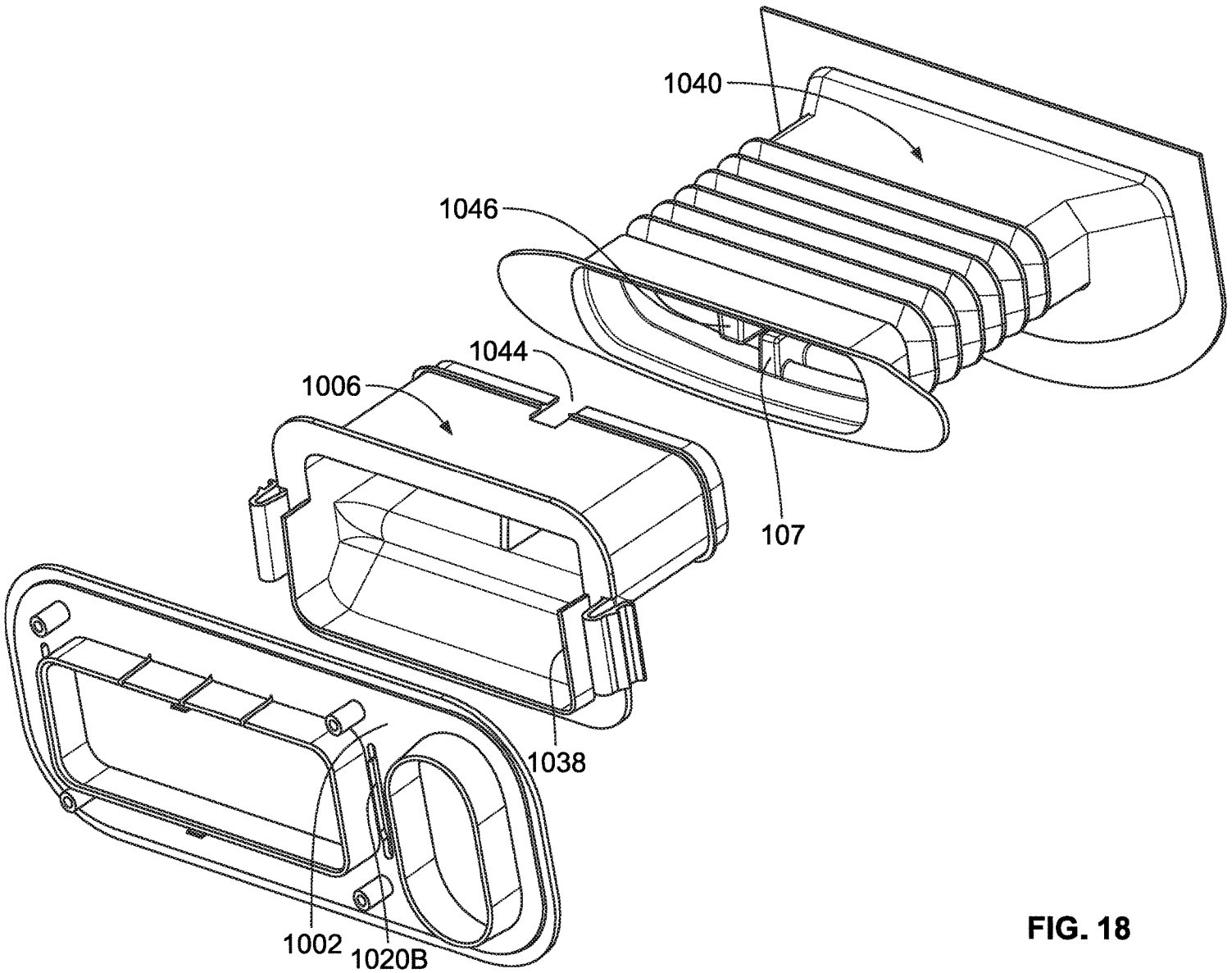
FIG. 18 is another perspective, exploded view of the first attachment plate, the plenum, and the air duct hose of FIG. 17.

FIG. 18 is another perspective, exploded view of the first attachment plate 1002, the plenum 1006, and the air duct hose 1040 of FIG. 17. As shown and described in reference to FIG. 17, the air duct hose 1040 includes the key 1046, which is received by the matching slot 1044 of the plenum 1006 when the air duct hose 1040 is slid over the plenum 1006. The air duct hose 1040 attached to the plenum 1006 can then be retained to the first attachment plate 1002 as described above. In some implementations, the air duct hose

1040 also includes the center rib 107 positioned therein (e.g., refer to FIG. 17). The center rib 107 can provide structural support to the air duct hose 1040 so that the air duct hose 1040 does not collapse or restrict air flow through the air duct hose 1040 when pressure is applied to the hose 1040 or components of the bed system. In some implementations, the key 1046 can extend along a center length of the air duct hose 1040 and can provide similar structural support as a center rib would.

Figure 19:
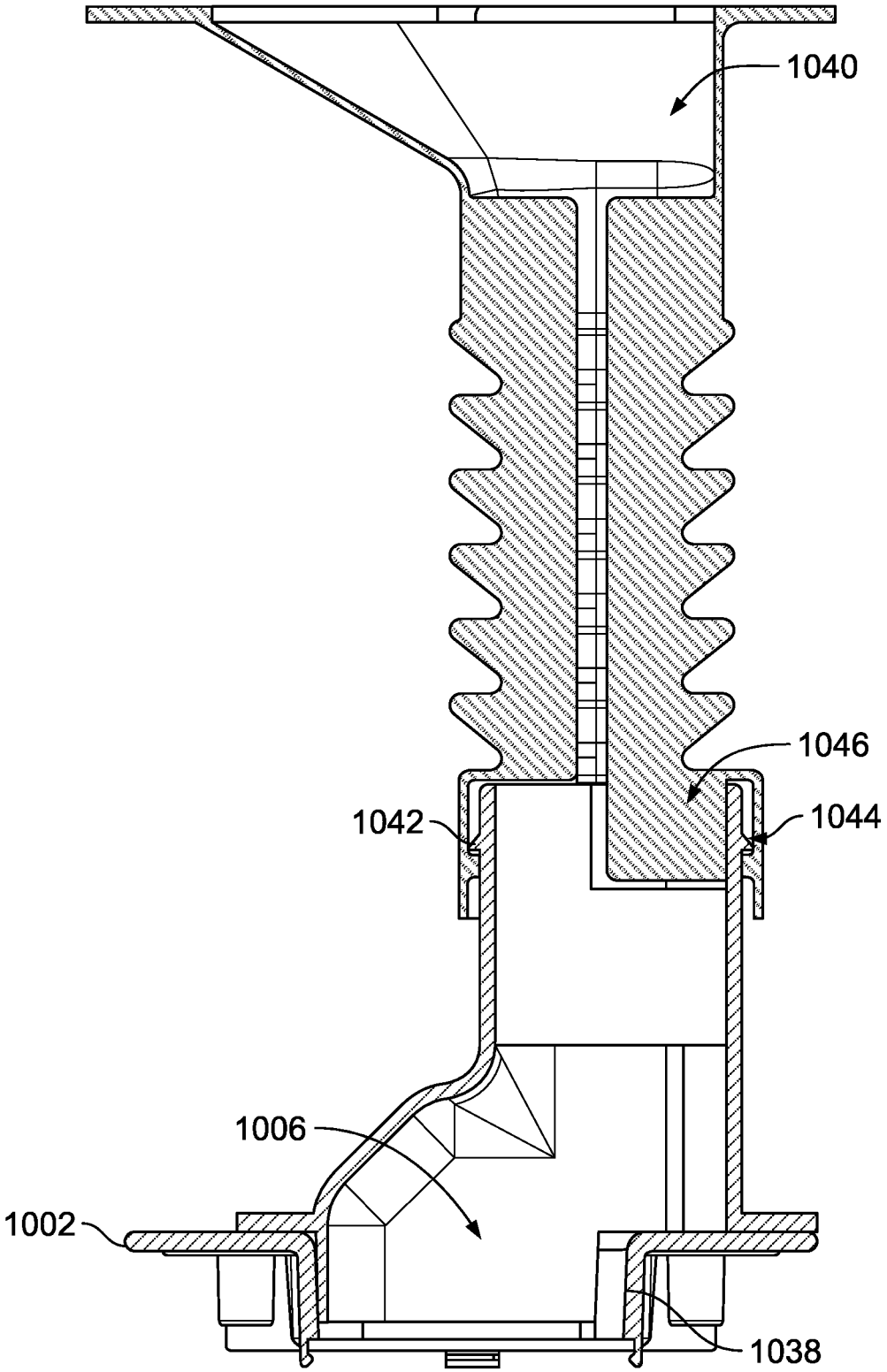
FIG. 19 is a cross sectional view of the first attachment plate, the plenum, and the air duct hose that are in an assembled state.

FIG. 19 is a cross sectional view of the first attachment plate 1002, the plenum 1006, and the air duct hose 1040 that are in an assembled state. As shown, the slot 1044 of the plenum 1006 is sized to receive the key 1046 of the air duct hose 1040. One or more ribs, or a portion of the hose 1040, can also secure around the ridge 1042 to retain the air duct hose 1040 to the plenum 1006. Thus, end portions of the air duct hose 1040 can extend over and around an exterior of the plenum 1006 such that the end portion of the air duct hose 1040 covers the plenum 1006.

Figure 20:
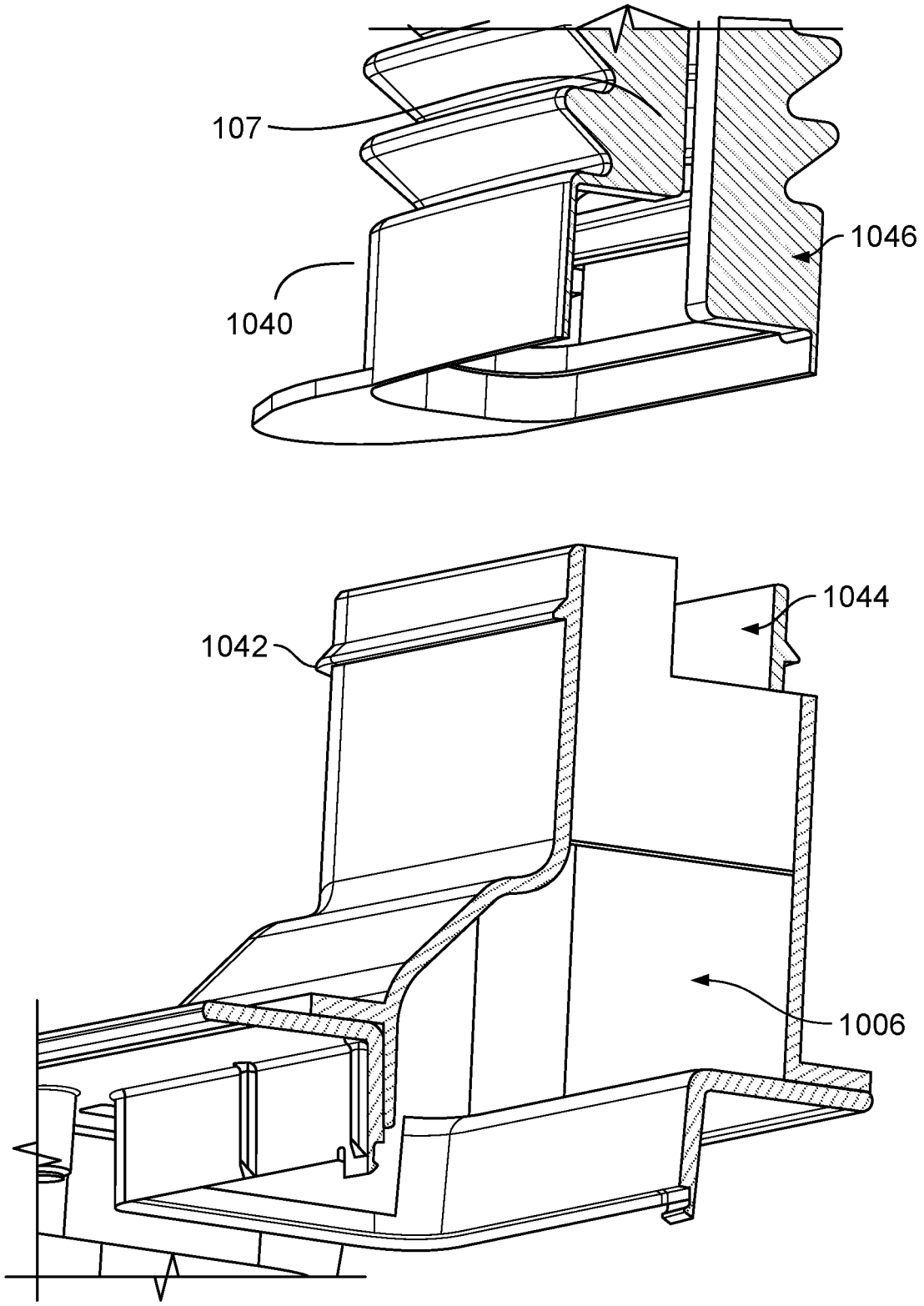
FIG. 20 is another perspective, cutout view of the first attachment plate, the plenum, and the air duct hose.

FIG. 20 is another perspective, cutout view of the first attachment plate 1002, the plenum 1006, and the air duct hose 1040. Like FIGS. 18-19, FIG. 20 depicts the key 1046 of the air duct hose 1040 and the corresponding slot 1044 of the plenum 1006 that receives the key 1046 when the air duct hose 1040 is slid over the plenum 1006. As shown, the slot 1044 is sized to receive the particular key 1046 in a particular direction. As a result, a user or technician may only attach the air duct hose 1040 to the plenum 1006 in the particular direction. This makes it easier and more intuitive for the user or technician to service the air duct hose 1040 or the plenum 1006, regardless of a configuration of the bed system (e.g., thermal engine on a right or left side of the bed system).

Figure 21:
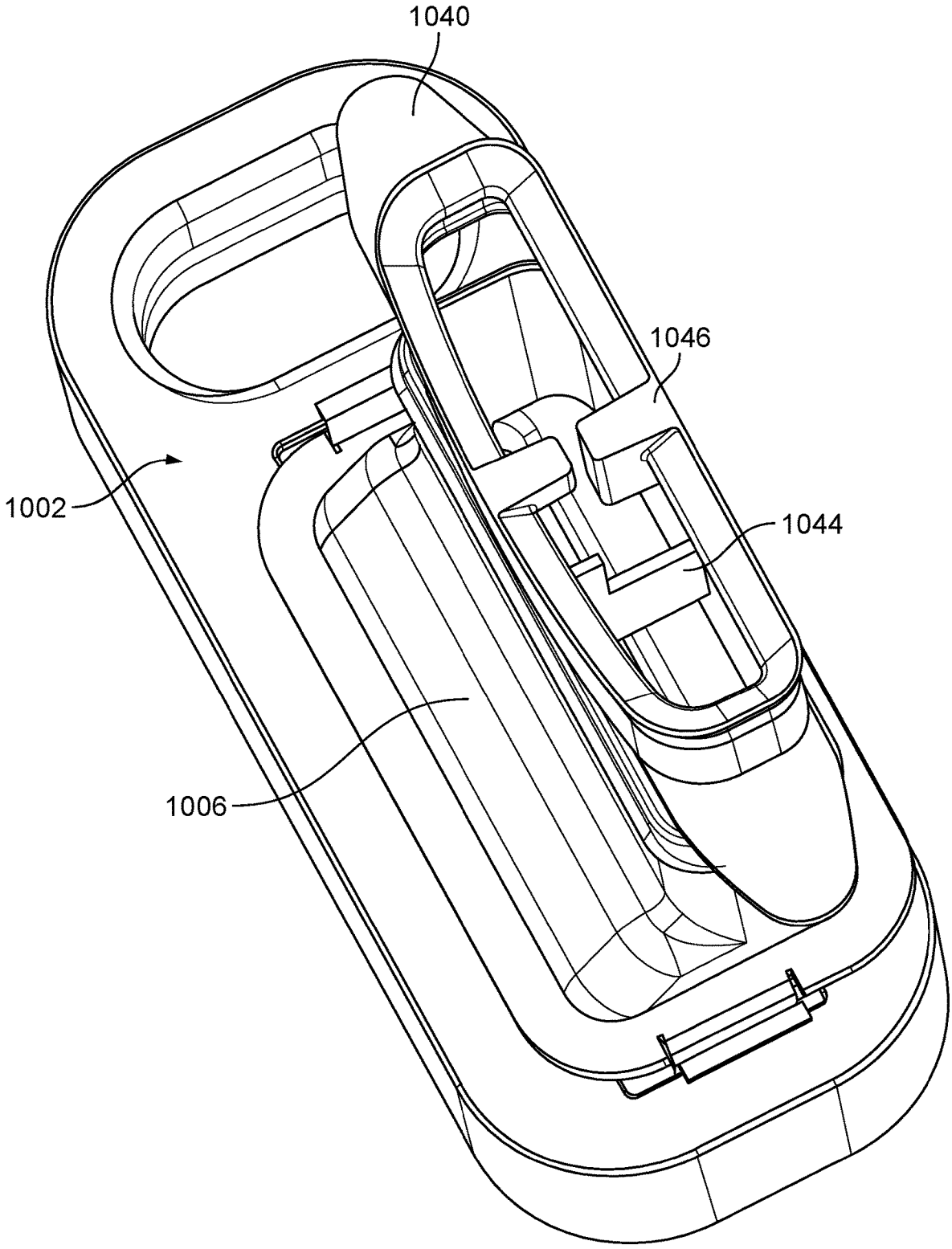
FIG. 21 is another perspective view of the first attachment plate, the plenum, and the air duct hose.

FIG. 21 is another perspective view of the first attachment plate 1002, the plenum 1006, and the air duct hose 1040. When the air duct hose 1040 is slid over at least a portion of the plenum 1006, the key 1046 of the air duct hose 1040 aligns with the slot 1044 at the center of the plenum 1006 such that the key 1046 is received by the slot 1044 and the air duct hose 1040 is secured to the plenum 1006.

While this specification contains many specific implementation details, these should not be construed as limitations on the scope of the disclosed technology or of what may be claimed, but rather as descriptions of features that may be specific to particular embodiments of particular disclosed technologies. Certain features that are described in this specification in the context of separate embodiments can also be implemented in combination in a single embodiment in part or in whole. Conversely, various features that are described in the context of a single embodiment can also be implemented in multiple embodiments separately or in any suitable subcombination. Moreover, although features may be described herein as acting in certain combinations and/or initially claimed as such, one or more features from a claimed combination can in some cases be excised from the combination, and the claimed combination may be directed to a subcombination or variation of a subcombination. Similarly, while operations may be described in a particular order, this should not be understood as requiring that such operations be performed in the particular order or in sequential order, or that all operations be performed, to achieve desirable results. Particular embodiments of the subject matter have been described. Other embodiments are within the scope of the following claims.

What is claimed is:

1. A bed system comprising:

a mattress;

a foundation having a first foundation side and a second foundation side, the foundation configured to support the mattress on the first foundation side, the foundation defining a foundation aperture extending between the first foundation side and the second foundation side;

an attachment plate that is mounted at the first foundation side of the foundation and defines a plate opening that is aligned with the foundation aperture; and a plenum having a first plenum end and an opposite second plenum end, the first plenum end configured to removably couple to the attachment plate at the first foundation side, and the second plenum end configured to couple to an air duct hose that is fluidly connected to the mattress;

wherein the air duct hose at least partially extends through the mattress and has a first hose end being exposed outside the mattress and a second hose end opposite the first hose end, wherein the second hose end of the air duct hose is configured to fit over at least a portion of the plenum to retain the air duct hose to the plenum;

wherein the air duct hose includes a key and the plenum includes a slot that is configured to receive the key to retain the air duct hose to the plenum.

2. The bed system of claim 1, wherein the air duct hose includes a center rib positioned along an inside the air duct hose and configured to provide structural support to the air duct hose to maintain air flow through the air duct hose when pressure is applied to one or more components of the bed system.

3. The bed system of claim 1, wherein the plenum includes first and second engagement tabs, and wherein the first and second engagement tabs are configured to snap fit into first and second apertures on opposing sides of a top surface of the attachment plate.

4. The bed system of claim 3, wherein the first and second engagement tabs include respective first and second flanges configured to engage with respective portions of the attachment plate adjacent the first and second apertures when the first and second engagement tabs are inserted and snapped into the first and second apertures.

5. The bed system of claim 1, wherein the air duct hose is made of a first material, and the plenum is made of a second material being less flexible than the first material.

6. The bed system of claim 5, wherein the first material is silicone and the second material is plastic.

7. The bed system of claim 1, wherein the plenum defines an opening that is a same size as at least one of an opening of the air duct hose and the plate opening of the attachment plate.

8. The bed system of claim 1, further comprising an air distribution layer, wherein an end of the air duct hose is fluidly connected to the distribution layer.

9. A bed system comprising:

a mattress;

a foundation having a first foundation side and a second foundation side, the foundation configured to support the mattress on the first foundation side, the foundation defining a foundation aperture extending between the first foundation side and the second foundation side;

an attachment plate that is mounted at the first foundation side of the foundation and defines a plate opening that is aligned with the foundation aperture; and a plenum having a first plenum end and an opposite second plenum end, the first plenum end configured to removably couple to the attachment plate at the first foundation side, and the second plenum end configured to couple to an air duct hose that is fluidly connected to the mattress;

wherein the air duct hose at least partially extends through the mattress and has a first hose end being exposed outside the mattress and a second hose end opposite the first hose end, wherein the second hose end of the air duct hose is configured to fit over at least a portion of the plenum to retain the air duct hose to the plenum;

wherein the plenum further includes a ridge extending around a perimeter of the plenum, and wherein one or more ribs of the air duct hose are configured to slide over the ridge such that the ridge retains the air duct hose to the plenum.

10. The bed system of claim 9, wherein the plenum defines an opening that is a same size as at least one of an opening of the air duct hose and the plate opening of the attachment plate.

11. The bed system of claim 9, further comprising an air distribution layer, wherein an end of the air duct hose is fluidly connected to the distribution layer.

12. A bed system comprising:

a mattress;

a foundation having a first foundation side and a second foundation side, the foundation configured to support the mattress on the first foundation side, the foundation defining a foundation aperture extending between the first foundation side and the second foundation side;

an attachment plate that is mounted at the first foundation side of the foundation and defines a plate opening that is aligned with the foundation aperture;

a plenum having a first plenum end and an opposite second plenum end, the first plenum end configured to removably couple to the attachment plate at the first foundation side, and the second plenum end configured to couple to an air duct hose that is fluidly connected to the mattress; and an air controller configured to attach to the attachment plate, wherein the air controller includes a pivot bar, and wherein the attachment plate includes a receiving cup at a first portion of the attachment plate that is configured to receive the pivot bar of the air controller to thereby couple the air controller to the attachment plate.

13. The bed system of claim 12, wherein the attachment plate comprises a first attachment plate and a second attachment plate, and wherein the second attachment plate includes (i) the receiving cup at a first portion of the second attachment plate configured to receive the pivot bar of the air controller and (ii) a locking tab at a bottom surface of the second attachment plate configured to engage with an engagement portion of the air controller.

14. The bed system of claim 13, wherein the first attachment plate includes engagement connectors along a perimeter of a bottom surface of the first attachment plate configured to snap fit into corresponding receivers along a perimeter of a top surface of the second attachment plate, thereby coupling the first attachment plate to the second attachment plate.

15. The bed system of claim 13, wherein the first attachment plate is placed at the first foundation side and the second attachment plate is placed at the second foundation side.

16. The bed system of claim 13, wherein the first attachment plate includes first and second apertures on opposing sides of a top surface of the first attachment plate configured to receive first and second engagement tabs of the plenum.

17. The bed system of claim 16, wherein the plenum is configured to couple to the first attachment plate with one or more engagement tabs being snap-fitted to the first and second apertures.

18. The bed system of claim 12, wherein the air controller is in fluid communication with the air duct hose through the foundation aperture and the plate opening.

19. A bed system comprising:

a mattress;

a foundation having a first foundation side and a second foundation side, the foundation configured to support the mattress on the first foundation side, the foundation defining a foundation aperture extending between the first foundation side and the second foundation side;

an attachment plate that is mounted at the first foundation side of the foundation and defines a plate opening that is aligned with the foundation aperture; and a plenum having a first plenum end and an opposite second plenum end, the first plenum end configured to removably couple to the attachment plate at the first foundation side, and the second plenum end configured to couple to an air duct hose that is fluidly connected to the mattress;

wherein the plenum includes first and second engagement tabs, and wherein the first and second engagement tabs are configured to snap fit into first and second apertures on opposing sides of a top surface of the attachment plate;

wherein the first and second engagement tabs include respective first and second flanges configured to engage with respective portions of the attachment plate adjacent the first and second apertures when the first and second engagement tabs are inserted and snapped into the first and second apertures;

wherein the first and second engagement tabs include U-shape portions configured to be flexed in a direction towards the plenum such that the first and second flanges disengage from the respective portions of the attachment plate to detach the plenum from the attachment plate.

20. A bed system comprising:

a mattress;

a foundation having a first foundation side and a second foundation side, the foundation configured to support the mattress on the first foundation side, the foundation defining a foundation aperture extending between the first foundation side and the second foundation side;

an attachment plate that is mounted at the first foundation side of the foundation and defines a plate opening that is aligned with the foundation aperture; and a plenum having a first plenum end and an opposite second plenum end, the first plenum end configured to removably couple to the attachment plate at the first foundation side, and the second plenum end configured to couple to an air duct hose that is fluidly connected to the mattress;

wherein the plenum includes first and second engagement tabs, and wherein the first and second engagement tabs are configured to snap fit into first and second apertures on opposing sides of a top surface of the attachment plate;

wherein the first and second engagement tabs are configured to be flexed as the first and second engagement tabs are pushed through the first and second apertures on opposing sides of the top surface of the attachment plate to engage the plenum to the attachment plate.

* * * * *